US008671657B2

(12) United States Patent
Malina

(10) Patent No.: US 8,671,657 B2
(45) Date of Patent: Mar. 18, 2014

(54) DRAWING FRAME FOR A SPINNING MACHINE

(75) Inventor: Ludek Malina, Kloten (CH)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 13/577,892

(22) PCT Filed: Feb. 11, 2011

(86) PCT No.: PCT/CH2011/000025

§ 371 (c)(1),
(2), (4) Date: Aug. 8, 2012

(87) PCT Pub. No.: WO2011/097746

PCT Pub. Date: Aug. 18, 2011

(65) Prior Publication Data

US 2012/0297748 A1 Nov. 29, 2012

(30) Foreign Application Priority Data

Feb. 12, 2010 (CH) ..... 180/10

(51) Int. Cl.
*D01H 5/18* (2006.01)

(52) U.S. Cl.
USPC ..... 57/315

(58) Field of Classification Search
USPC ..... 57/315; 19/266, 267, 271, 294, 295
See application file for complete search history.

(56) References Cited

U.S. PATENT DOCUMENTS

| | | | | | |
|---|---|---|---|---|---|
| 1,782,624 | A | * | 11/1930 | McGee | 19/285 |
| 1,933,222 | A | * | 10/1933 | Rooney | 19/294 |
| 2,329,655 | A | * | 9/1943 | Shaw | 19/252 |
| 2,965,934 | A | * | 12/1960 | Swanson | 19/266 |
| 3,216,065 | A | * | 11/1965 | Grieb | 19/294 |
| 3,303,534 | A | * | 2/1967 | Andreani | 19/248 |
| 3,568,258 | A | * | 3/1971 | Schiltknecht et al. | 19/295 |
| 3,619,870 | A | * | 11/1971 | Ooki et al. | 19/282 |
| 3,663,992 | A | * | 5/1972 | Ooki et al. | 19/281 |
| 3,732,596 | A | * | 5/1973 | Staneff | 19/267 |
| 3,736,626 | A | * | 6/1973 | Staneff | 19/295 |
| 3,740,798 | A | * | 6/1973 | Brichta et al. | 19/267 |
| 4,012,810 | A | * | 3/1977 | Stahlecker | 19/294 |
| 4,484,376 | A | * | 11/1984 | Glock et al. | 19/0.25 |
| 4,768,262 | A | * | 9/1988 | Gunter | 19/258 |
| 5,012,557 | A | * | 5/1991 | Stahlecker et al. | 19/258 |
| 5,048,157 | A | * | 9/1991 | Wehrli | 19/288 |

FOREIGN PATENT DOCUMENTS

| | | |
|---|---|---|
| DE | 39 04 348 A1 | 8/1990 |
| DE | 196 25 526 A1 | 1/1998 |

(Continued)

*Primary Examiner* — Shaun R Hurley
(74) *Attorney, Agent, or Firm* — Dority & Manning, P.A.

(57) ABSTRACT

The invention relates to a spinning machine, the drafting arrangement of which comprises a drafting arrangement unit (35, 65, 95) with a first pair of rollers consisting of a first bottom roller (22) and a first top roller (21, 41, 71). The drafting arrangement unit (35, 65 95) is configured as an assembly which is detachably fastened to the spinning machine by means of a fastening device (11, 59). The drafting arrangement unit (35, 65, 95) is designed for one spinning station or as a twin drafting arrangement unit for two adjacent spinning stations. The unit can also include further rollers which, together with the first pair of rollers, form a drafting zone of the drafting arrangement.

17 Claims, 13 Drawing Sheets

(56) References Cited

FOREIGN PATENT DOCUMENTS

| | | | |
|---|---|---|---|
| DE | 10 2004 062 796 | A1 | 6/2006 |
| EP | 0 350 797 | | 1/1990 |
| EP | 1 304 403 | | 4/2003 |
| WO | WO 2005/026421 | A1 | 3/2005 |
| WO | WO 2008/052370 | A1 | 5/2008 |

* cited by examiner

DRAWING FRAME FOR A SPINNING MACHINE

FIELD OF THE INVENTION

The invention relates to a drafting arrangement unit for a spinning machine, the drafting arrangement having a first bottom roller. The invention further relates to a spinning machine having a drafting arrangement unit, combinations of such a spinning machine with other spinning machines, and to a spinning machine assembly kit.

BACKGROUND

A drafting arrangement has the task to draw or draft a delivered fiber strand in order to reduce in this manner the number of fibers in cross-section. During drafting, the fibers have be displaced relative to each other as uniform as possible while overcoming static friction so that, as a result, a fiber strand as uniform as possible and subsequently a harmonious yarn is obtained.

In the case of spinning machines, a distinction is made between preliminary spinning machines and final spinning machines, also called fine spinning machines. Preliminary machines, which include in particular roving frames, produce a roving from a sliver, in particular from a drafter sliver, which roving is processed in the next process stage into a yarn by means of a final spinning machine. Accordingly, preliminary spinning machines comprise a drafting arrangement which drafts a sliver, in particular a drafter sliver, so as to achieve the fineness of a roving. Final spinning machines, in turn, comprise in each case drafting arrangements which draft the roving to the fineness of a yarn. Also known are final spinning machines, the drafting arrangements of which, while omitting the preliminary spinning machine, are designed to draft a drafter sliver in one process stage up to the fineness of a yarn. In literature, the associated drafting arrangements are called high-draft drafting arrangements. Within the context of this invention, all above-mentioned drafting arrangement types, alone or in combination with one of the mentioned spinning machines, shall come within the scope of the present invention.

A drafting arrangement usually comprises a plurality of successively arranged pairs of rollers which each forming a clamping line or a clamping region. The pairs of rollers consist in each case of a bottom roller that is usually driven and an upper pressure roller through which the fiber strand is clamped. The fiber strand is transported through the pairs of rollers to a twist generation. The draft is generated in that the circumferential speed increases in the running direction of the fibers from roller pair to roller pair. The draft between the last two roller pairs in the running direction of the fibers is called main draft; the sections upstream thereof are called break draft. There are spinning machines which have one or two break drafts, while spinning machines having only two pairs of rollers, thus effect only the actual main draft, are not known in practice.

Drawing a part of the fibers is carried out by carrying the fibers along on the roller surfaces or aprons arranged thereabove, for which reason the fibers have to adopt approximately the circumferential speed of the rollers. Transmitting the roller movement to the fibers to be transported takes place through friction.

The roller pair from the clamping point of which the main draft starts contributes to good guidance of the fibers. Here, it is frequently the case that each of the two rollers is supplemented by at least one further deflection element and an apron running about the latter and the rollers. This construction is known as a double-apron drafting arrangement.

An alternative to this is the Kepa drafting arrangement, named after the inventors Kern and Pauen, which has modified this established structure: Bottom roller and cage of the roller pair which initiates the main draft are replaced by a large bottom roller while the top apron and its cage have a particularly long design so that the top apron and the large bottom roller are in contact as long as possible to achieve a good fiber guidance. Like a conventional drafting arrangement, the Kepa drafting arrangement can be implemented as two-, three- or four-roller drafting arrangement. The Kepa drafting arrangement is also used as a high-draft drafting arrangement, whereby the requirements for exact fiber guidance are even higher. Such a drafting arrangement is described, e.g., in the European patent specification EP 0 350 797 B1.

As can be derived from the above descriptions, the drafting arrangement is the centerpiece of a spinning machine because here, the quality of the produced yarn is determined. Changes in the drafting arrangement and to its geometry can have a significant influence on quality. This is certainly one of the reasons that in the sector of drafting arrangements of spinning machines, no fundamental changes have been made for a long time. Thus, the drafting arrangements of ring spinning machines are still driven by common rollers which extend over a plurality of spinning stations or an entire longitudinal machine side. Accordingly, drafting arrangements on one side of a machine have to be operated synchronously. Operating the spinning stations individually is not possible. The ever-increasing length of spinning machines cause torsion problems in the drafting arrangements so that multiple drives have to be used for operation. Thus, shutting down or individually maintaining the drafting arrangements is possible only to a limited extent.

SUMMARY

It is an object of the present invention to provide a spinning machine with a plurality of spinning stations and associated drafting arrangements, which allows more flexibility when operating the spinning stations and simplifies maintaining the drafting arrangements without the need to limit the operation on the spinning machine. Additional objects and advantages of the invention will be set forth in part in the following description, or may be obvious from the description, or may be learned through practice of the invention.

The objects are achieved in that the drafting arrangement unit is configured as an assembly, wherein the first bottom roller is rotatably mounted via its roller axle on a base carrier of the drafting arrangement unit, and wherein the drafting arrangement unit includes a first top roller, and the first bottom roller and the second roller form a first roller pair which, in the operating position, forms a clamping region. The first top roller is fastened to the base carrier via a load device, in particular via a pivotable guide arm, and the drafting arrangement unit can be detachably fitted on the spinning machine by means of a fastening device, wherein the drafting arrangement unit is designed for one spinning station or a plurality of adjacent spinning stations, thus only for a portion of the spinning stations of the spinning machine. In a particular embodiment, the unit is designed as a twin drafting arrangement unit for two adjacent spinning stations. The first bottom roller can be followed by a second bottom roller in the unit.

To be mentioned as prior art for this concept is the publication of the German Patent Application DE 39 04 348. However, with the device described therein, the above-described disadvantages of conventional drafting arrangements cannot be avoided.

With embodiments according to the present invention, the first top roller and optionally further rollers are preferably fastened to the base carrier via a load device, in particular via a pivotable guide arm.

According to a preferred refinement of the invention, the drafting arrangement unit contains a second top roller which is arranged in the process direction downstream of the first top roller and which, together with a second driven bottom roller, forms a second roller pair with a clamping region. Between the first and second roller pairs, preferably, a main draft is formed. The second bottom roller can be installed in the drafting arrangement unit or separately. However, in a preferred embodiment of the invention, the second driven bottom roller is arranged on the spinning machine. In this case, the second bottom roller extends over a plurality of spinning stations in the longitudinal direction of the machine.

The bottom rollers are adequately segmented and extend preferably only over the drafting arrangement region of one spinning station or one pair of spinning stations. Likewise, the top rollers of the drafting arrangement units are also segmented, as this is already the case in today's spinning machines, i.e., they preferably extend only over the drafting arrangement region of one spinning station or one pair of spinning stations.

The bottom roller(s) is/are preferably connected to the base carrier by means of bearing receptacles. The drafting arrangement unit can be suitably fitted and fixed on the spinning machine via the base carrier. Preferably, the drafting arrangement unit rests via the base carrier on the drafting arrangement carrier. For this purpose, the base carrier can include first guiding means which interact with the second guiding means on the spinning machine or on the drafting arrangement carrier. The guiding device with the first and second guiding means enables positioning and aligning the drafting arrangement unit on the spinning machine. The guiding device can be designed for positioning the drafting arrangement unit in the fiber flow direction as well as transverse thereto. Furthermore, the guiding device can also be designed for adjusting the outfeed angle of the sliver, i.e., for adjusting the inclination of the drafting arrangement.

On the base carrier, adjusting means can be provided which allow displacing the first bottom roller, and optionally the infeed bottom roller, and optionally the second bottom roller with respect to the base carrier and transverse to the roller axis in the fiber flow direction. In this manner, the size of the drafting zones, i.e., the spacing between the rollers on the drafting arrangement, can be adjusted. It is also possible that the drafting distances can only be adjusted through adjustability of the top rollers. The guiding device or the adjusting means can include a rail guide.

Furthermore, adjusting means can be provided which allow displacing the drafting arrangement carrier and/or the drive shaft relative to the spinning machine, e.g. in the fiber flow direction. The drafting arrangement carrier and the drive shaft can be fastened via connecting elements to the cylinder supports.

The base carrier can be configured as one piece or multiple pieces. The base carrier or the individual base carrier elements can consist of rolled products, castings or pressed parts. Furthermore, the base carrier can include a housing for receiving rolling bearings and/or a gearing arrangement.

By means of the load device, the first top roller can be pressed in the operating position against the first bottom roller. If the drafting arrangement unit includes a second top roller, this roller can also be pressed via the load device in the operating position against the second bottom roller. The load device preferably includes a pivotable guide arm, also called load arm, on which the top roller(s) is/are mounted. The guide arm is pivotably mounted via a hinge joint directly or indirectly on the spinning machine and preferably on the drafting arrangement unit in such a manner that the top roller(s) can be pivoted perpendicular to the direction of the roller axis and away from the bottom roller(s) or toward the bottom roller(s). The guide arm can be pivotably secured on the base carrier of the drafting arrangement unit via a further component.

Loading the guide arm is preferably carried out via a tensioning device. This tensioning device may include first tensioning means on the load device and second tensioning means on the drafting arrangement unit, and/or on the spinning machine, in particular on the drafting arrangement carrier. The tensioning device is preferably a quick-release tensioner, as described in more detail below in connection with the fastening device. Here, the tensioning device is part of the fastening device.

The fastening device includes fastening means which are suitably arranged on the drafting arrangement unit and by means of which the drafting arrangement unit, in interaction with second fastening means arranged on the spinning machine and/or likewise on the drafting arrangement unit, can be detachably fastened on the spinning machine.

The detachable fastening device is preferably a quick release fastener, in particular a quick release tensioner. The quick release tensioner is characterized by being self-locking in the closed position. For generating self-locking, the quick release tensioner can work together with an eccentric which is actuated by a lever, the so-called tensioning lever. During the tensioning process, the eccentric is pivoted slightly beyond a pressure point and mechanically stopped.

Instead of an eccentric, the quick release tensioner can also be an interaction of a groove and a cam, wherein upon exceeding a tensioning force, a first pivotable fastening means falls into a self-locking position by latching a cam into a groove. Here, the first fastening means receives the groove or the cam, and the second fastening means receives the cam or the groove.

The quick release tensioner can also comprise a toggle lever mechanism wherein a locking lever rotatably mounted via an articulated joint can be guided to a limit stop thereby falling into a self-locking closing position. All quick release tensioners have in common that for setting the self-locking feature, a lever movement about a pivot axis is necessary.

The fixation force of the quick release device for self-locking, in particular if a tensioning device for the guide arm is involved, is preferably adjustable, in particular by an adjusting screw. For generating an additional operational load on the guide arm, a pressure generating device can be provided which, via the second tensioning means, can exert additional pressure on the guide arm.

For implementing the aforementioned refinement, the second clamping means can include a pressure arm which is pivotably secured on the base carrier of the drafting arrangement or the spinning machine and which, in the operating position, is in operative connection with the pressure device on the spinning machine. The pressure device can operate, e.g., pneumatically or hydraulically. The pressure device can be provided individually per spinning station or pair of spinning stations, or over a plurality of spinning stations, e.g., over a section. This allows common pressure application or pressure release for a plurality of spinning stations.

The drafting arrangement carrier is preferably configured as an open or closed longitudinal profile, preferably a tubular profile, in particular a quadrangular tubular profile or hexagonal tubular profile. The drafting arrangement carrier extends in the longitudinal direction of the machine over one or a plurality of spinning stations of one machine side. The drafting arrangement carrier can be made of one piece or multiple pieces. The drafting arrangement carrier is preferably fastened on cylinder supports.

For driving purposes, the drafting arrangement unit is preferably connected to the spinning machine via a coupling device by means of which the first bottom roller can be coupled to a drive shaft of the spinning machine. Here, a coupling device is a machine element for transmitting torques with shafts. The coupling device serves for establishing a connection for transmitting torque from the drive shaft of the spinning machine to at least one first bottom roller of the drafting arrangement unit. Accordingly, the coupling device comprises first coupling means on the drafting arrangement unit and second coupling means on the spinning machine. The drive shaft on the spinning machine preferably extends over a plurality of, in particular more than two, spinning stations, in particular over one or a plurality of sections, or over all spinning stations in the longitudinal direction of the machine.

Thus, the first bottom roller receives a torque from the drive shaft via the coupling device. The coupling device is preferably part of a gearing arrangement with first gearing means on the drafting arrangement unit and second gearing means on the spinning machine. The gearing arrangement can be, e.g., a gear drive, a worm gear drive or a friction gear drive. Furthermore, the use of belt drives is also conceivable. Preferably, a transmission gearing is provided between the bottom roller and the drive shaft.

The individual coupling devices and gear units can be used independently of the selected drafting arrangement concept and are therefore not limited to the respective drafting arrangement design with which together they are described.

If the drafting arrangement unit also includes the second bottom roller, this second bottom roller is preferably connected in the same manner and with the same means to a drive shaft on the spinning machine as described above. The first and second bottom rollers can receive their torque from the same drive shaft on the spinning machine. In this case, a transmission gearing is allocated to at least one of the bottom rollers. It is also possible that the first and second bottom rollers receive their torque from different drive shafts on the spinning machine. Both drive shafts preferably extend over a plurality, in particular more than two spinning stations, in particular over one or a plurality of sections, or over all spinning stations in the longitudinal direction of the machine.

However, the drafting arrangement unit can also be equipped with one or a plurality of electromotive single-motor drive(s) for driving the first and/or the second bottom roller. The single-motor drive drives the lower shaft directly or indirectly via a gear unit. A possible gear unit is also part of the drafting arrangement unit. The drafting arrangement units are adequately provided with interfaces via which the single-motor drives can be connected to the power supply of the spinning machine. Furthermore, data interfaces are provided via which the drives can be connected the machine control or to another control outside of the drafting arrangement unit.

The invention further relates to a spinning machine having at least one and preferably a multiplicity of the drafting arrangement units according to the invention. The spinning machine is characterized in that the drafting arrangement unit as an assembly is detachably fixed to the spinning machine via a fastening device.

The drafting arrangement unit is attached to the spinning machine, in particular to the drafting arrangement carrier, via the base carrier. The base carrier can have first guiding means which interact with the second guiding means on a component, in particular on a drafting arrangement carrier of the spinning machine. The guiding device with first and second guiding means allows positioning and aligning the drafting arrangement unit on the spinning machine. The guiding unit can comprise a rail guide, in particular a slide rail guide by means of which the drafting arrangement unit is slid onto the drafting arrangement carrier or another component on the spinning machine, moved to the correct position, and fixed or locked by means of the fastening device.

The spinning machine preferably comprises a driven shaft extending over a plurality of spinning stations, in particular over more than two spinning stations, advantageously over one or a plurality of sections. Second coupling means are connected on one side directly or indirectly to the driven shaft and on the other side to the first coupling means on the drafting arrangement unit so that the driving power of the first bottom roller can be fed to the drafting arrangement unit. For each spinning station or for each pair of spinning stations, one such coupling device is provided.

In the case of two-sided spinning machines, a separate drive shaft for driving the first bottom roller of the drafting arrangement unit can be provided for each machine side. However, it is also possible that a common drive shaft is provided for both machine sides. Accordingly, coupling devices are directed toward the spinning stations of both machine sides. In this case, in a cross-sectional view, the drive shaft is arranged more or less central in the center of the machine.

The spinning machine preferably comprises a drafting arrangement carrier extending along a plurality of spinning stations, preferably over more than two spinning stations, in particular over one or a plurality of sections, and particularly preferred over all spinning stations of a machine side. For each spinning station or pair of spinning stations, preferably, second fastening means for receiving a drafting arrangement unit are attached to the drafting arrangement carrier. Furthermore, as already mentioned, second guiding means can also be arranged on the drafting arrangement carrier.

Locking the drafting arrangement unit on the spinning machine as well as loading the guide arm, i.e., pressing the top rollers against the bottom rollers, is preferably carried out via the fastening device. As already described above, the operating load on the guide arm can be exerted pneumatically or hydraulically in a manner known per se. Accordingly, a pneumatic or hydraulic pressure device can be provided on the spinning machine.

Here, the drafting arrangement unit of the spinning machine can comprise a load device with a guide arm, and loading the guide arm can take place via a first tensioning device with first tensioning means on the guide arm and second tensioning means on the spinning machine, wherein the tensioning device is preferably part of the fastening device.

Furthermore, it is proposed that locking the drafting arrangement unit on the spinning machine, as well as loading the guide arm, is carried out via the fastening device.

Viewed in the processing direction, the spinning machine can comprise an additional pair of infeed rollers which is arranged upstream of the first pair of rollers. Between the pair of infeed rollers and the first pair of rollers, a break draft zone is formed. The bottom or top roller of the pair of infeed rollers is driven. However, preferably, the bottom infeed roller is driven. In this case, the driven bottom infeed roller extends over a plurality of, in particular more than two, spinning stations, in particular over one or a plurality of sections, or over all spinning stations in the longitudinal direction of the machine.

The drive shaft of the infeed roller preferably extends over a plurality of, in particular more than two, spinning stations, in particular over one or a plurality of sections or over all spinning stations in the longitudinal direction of the machine. As an alternative to this, the drafting arrangement unit can comprise an electromotive single-motor drive for driving the bottom infeed roller. Between the bottom infeed roller and the drive, a gearing arrangement can be provided. Possible coupling devices can be part of gearing arrangements per spinning station or pair of spinning stations. For further embodiments of the drive concept of the bottom infeed roller, reference is made to the explanations above on the drive of the first bottom roller, which shall also apply to the bottom infeed roller.

Furthermore, on the outfeed side of the drafting zone of the drafting arrangement, a pneumatic compacting device can be arranged which compacts the drafted sliver. According to this particular refinement, the bottom outfeed roller advantageously corresponds to a driven suction roller. In operating position, the top outfeed roller rests on the suction roller and forms an outfeed clamping line with the latter. Subsequent to the top outfeed roller in the processing direction, a twist stop top roller is arranged which, together with the suction roller, forms a twist stop gap. The compacting zone on the suction roller lies between the top outfeed roller and the twist stop top roller. The twist stop top roller is preferably also arranged on the load device, in particular via a bearing receptacle on the guide arm of the drafting arrangement. The suction roller and the associated suction device, however, are advantageously attached to the spinning machine and extend over one or a plurality of spinning stations in the longitudinal direction of the machine. Such a compacting device is described, e.g., in EP-A-1 304 403 or DE-196 25 526.

Instead of a suction roller with a driven outer circumference, it is also possible to provide a low-pressure channel for fiber bundling devices, which channel is made of a tubular base carrier and arranged subsequent to the compaction zone, i.e., subsequent to the pair of outfeed rollers, and the outer contour of which comprises for each spinning station a first sliding surface for a conveyor belt that is permeable to air, the sliding surface comprising a suction slot substantially running in the circumferential direction of the base carrier. The twist stop gap is formed here by the base carrier and a twist stop top roller which, subsequent to the compaction zone, rests against the base carrier. The twist stop roller, e.g., can be driven and in this manner, in turn, drives the conveyor belt. Here too, the twist stop top roller is preferably connected to the load device, in particular connected via a bearing receptacle to the guide arm of the drafting arrangement unit. The low-pressure channel and the associated suction device, however, are advantageously attached to the spinning machine and extend over one or a plurality of spinning stations in the longitudinal direction of the machine. Such a device is described, e.g., in DE-A-10 2004 062 796.

The spinning machine or the drafting arrangement units can further comprise aggregates for producing effect yarn and/or core yarns. For core yarn, this can be, e.g., deflection guides which feed the core yarn to the fiber strand at the desired position. Subsequent to the drafting arrangement unit or the compacting device, a twisting and winding device for the yarn follows at each spinning station. The spinning machine with drafting arrangement according to the invention is preferably an air-jet spinning machine, a ring spinning machine, a funnel spinning machine, a loop spinning machine, a pot spinning machine or a roving spinning machine, in particular a roving frame.

In the following, the drafting arrangement is discussed in more detail. The drafting arrangement unit or the drafting arrangement is not limited to a particular type of drafting arrangement. Rather, different drafting arrangement concepts can be implemented within the context of this invention. It is even a particular advantage of the present invention that, in the meaning of the likewise claimed assembly kit concept, different types of drafting arrangements can be used on a spinning machine. A detailed description of the possible types of drafting arrangements mentioned below can be found, e.g., in the publication WO 2008/052370.

According to a first embodiment of a drafting arrangement, the drafting arrangement is part of a conventional double-apron drafting arrangement. The first bottom roller is wrapped-around by an apron which is guided via a deflection device, preferably a deflection bridge. The first top roller, in turn, is wrapped-around by a top apron guided in a cage. In this manner, the lower and top aprons form an apron guide through which the fiber strand is guided in the main drafting zone. The drafting arrangement unit can further comprise a tensioning device, e.g. with a tensioning spring, which tensions the bottom apron and thus provides for a uniformly running apron.

According to a second embodiment of a drafting arrangement, the drafting arrangement unit is part of a Kepa drafting arrangement which has already been described in the introductory part of the specification. The Kepa drafting arrangement comprises a pair of rollers with an upper and a bottom roller which form a main drafting zone. A top apron is wrapped around the top roller and is tensioned via a suitable guide or apron cage in such a manner that it wraps around a portion of the circumference of the so-called lower Kepa roller. This means, the top apron runs along a partial circumference of the Kepa bottom roller. In the region of the joint partial wrap, the sliver is guided between the top apron and the bottom Kepa roller. The bottom Kepa roller is characterized, on the one hand, in that it is not wrapped-around by a bottom apron and, on the other, that it is significantly larger than the associated top roller or the main draft bottom roller of conventional double-apron drafting arrangements. In the present invention, the pair of Kepa rollers corresponds to the first pair of rollers.

According to a third embodiment of the drafting arrangement, the drafting arrangement unit is part of a double-apron drafting arrangement having a large bottom roller. Here, the bottom roller is likewise wrapped-around by a bottom apron. However, the diameter of the bottom roller is considerably larger than the one of the top roller or the one of conventional double-apron drafting arrangements and, e.g., can correspond to the diameter of a Kepa bottom roller. Accordingly, the wrap angle between bottom roller and top roller is considerably larger than in conventional double-apron drafting arrangements. The bottom roller is preferably coated with a material of high friction, e.g. with a rubber material. In this manner, slip between aprons and bottom rollers can be reduced.

The bottom apron is guided via a deflection device, in particular a deflection bridge. Analogous to the Kepa drafting arrangement, the top apron can wrap around a partial circumference of the main draft bottom roller, which is in addition also wrapped-around by the bottom apron. Thus, according to this refinement of the invention, top and bottom aprons can jointly wrap around a partial circumference of the bottom roller. In the region of the joint partial wrap, the sliver is guided between top and bottom aprons. The expansion of the mentioned partial circumference can correspond to the dimensions mentioned above in connection with the Kepa drafting arrangement.

In addition or as an alternative to this, a deflection guide toward the pair of delivery rollers can be provided on the delivery side of the main draft zone for the bottom apron, which effects that in the fiber flow direction, the bottom apron runs at an angle, e.g. tangentially, away from the bottom roller. The top apron preferably follows the path of the bottom apron so that between bottom and top aprons, a guided region is formed.

In a refinement of the invention, it can be provided that the top apron forms no or only an insignificant partial wrap with the main draft bottom roller. In this embodiment, in a segment facing toward the top apron, the bottom apron is led approximately tangentially away from the main draft bottom roller and is guided via a guide, in particular deflection bridge, that is arranged in the fiber flow direction subsequent to and spaced apart from the main draft bottom roller. Between the clamping region of the first top and bottom rollers and the deflection bridge, the top apron guided in a cage and the bottom apron together form a guide zone for the sliver.

The special feature of the described bottom roller with apron guide is that in contrast to conventional bottom apron guides, the bottom apron is guided via a considerably larger partial circumference of the main draft bottom roller. In this manner, the slip between bottom roller and bottom apron is significantly reduced.

The wrapping angle of the bottom apron on the large bottom roller is advantageously 140° or more, preferably 180° or more. Furthermore, the wrapping angle is preferably 270° or less, and in particular 225° or less. The wrap angle defines that circumferential region of the bottom roller on which the apron rests.

The large bottom roller according to the second and third embodiments of the drafting arrangement can have a diameter D of 30 mm or larger, preferably 35 mm or larger, in particular 40 mm or larger and particularly advantageously 50 mm or larger. Advantageously, the diameter D is 100 mm or smaller, preferably 80 mm or smaller and in particular 70 mm or smaller. A particularly preferred diameter range is 45 to 60 mm. The pair of main draft drafting arrangement rollers, with or without bottom apron guide, which comprises the large bottom roller, has a preferred diameter ratio of bottom roller to top roller of 1.2 or greater, in particular 1.5 or greater, advantageously 1.8 or greater. The diameter ratio is preferably 3 or smaller, in particular 2.5 or smaller and advantageously 2.2 or smaller.

The top apron cage as well as apron guides, e.g., deflection bridges, tensioning devices or lateral guide elements for the bottom apron, are preferably secured on the base carrier.

In order to avoid slip between roller and guide apron, positive guides such as, e.g., tooth systems, can be provided between the moving components.

In summary, the drafting arrangement according to the invention can comprise the following positive drive guides, such as tooth systems, individually or in any combination with each other:

a. the bottom apron of the first bottom roller has an internal toothing which meshes or is engaged with the external toothing of the first bottom roller;
b. the bottom apron of the first bottom roller has an external toothing which meshes or is engaged with an external toothing of the top apron of the first top roller;
c. the top apron of the first top roller has an external toothing which meshes or is engaged with an external toothing on the first bottom roller;
d. the first top roller has an external toothing which meshes or is engaged with the external toothing of the first bottom roller. The external toothing of the two first rollers can correspond to the external toothing according to point a. or d.
e. the bottom apron of the first bottom roller has an external toothing which meshes or is engaged with an external toothing of the first top roller.

The term toothing within the context of this patent application means any arrangements of elevations and/or indentations or openings in the surface of the respective machine part, wherein on the opposing machine part, indentations and/or elevations can be found which are formed in a mirror-inverted manner so that the two mentioned parts are in positive engagement with each other. A detailed description of such positive connections can also be found in the mentioned WO publication.

Drafting arrangement units of the same type of drafting arrangements or of different types of drafting arrangements, furthermore, are preferably characterized in that their connecting interfaces to the spinning machine are compatible to each other with regard to the fastening device and optionally the guide device and/or to the tensioning device.

Furthermore, with regard to the desired interchangeability of drafting arrangement units on the spinning machine, the drive interfaces (coupling device), developed within the context of a drive concept, between the first and optionally further bottom rollers and the drive shaft or shafts of the spinning machine shall be compatible to each other independent of the type of drafting arrangement implemented in the drafting arrangement unit.

In this manner, drafting arrangement units can be replaced with other drafting arrangement units in a simple manner and with little effort and independent of the type of drafting arrangement. Thus, through the specific use of certain types of drafting arrangements and specific settings of the drafting arrangements, different yarns can be produced. By segmenting the bottom roller(s) among the individual drafting arrangements or twin drafting arrangements, the distances between the rollers and thus the drafting zones or other geometries in the drafting arrangement can also be individually adjusted. Furthermore, the drafting arrangements or twin drafting arrangements can be operated or shut off independent of the other drafting arrangements.

Furthermore, a thread breakage monitoring system with thread breakage sensors can be installed on the spinning machine. Upon reporting a thread breakage at a spinning station, the respective spinning station or pair of spinning stations and the associated drafting arrangement can be shut off through a suitable control and actuators, wherein the remaining spinning stations still remain in operation. This can be done, e.g., by turning off the single-motor drive of the bottom roller(s) or by disconnecting a coupling connection between bottom roller(s) and drive shaft(s) of the spinning machine.

BRIEF DESCRIPTION OF THE DRAWINGS

The invention is explained in more detail hereinafter by means of the drawings, wherein the description shall not be understood as being exhaustive, but only serves the purpose of clarity. In the figures.

DESCRIPTION

Figure 1:
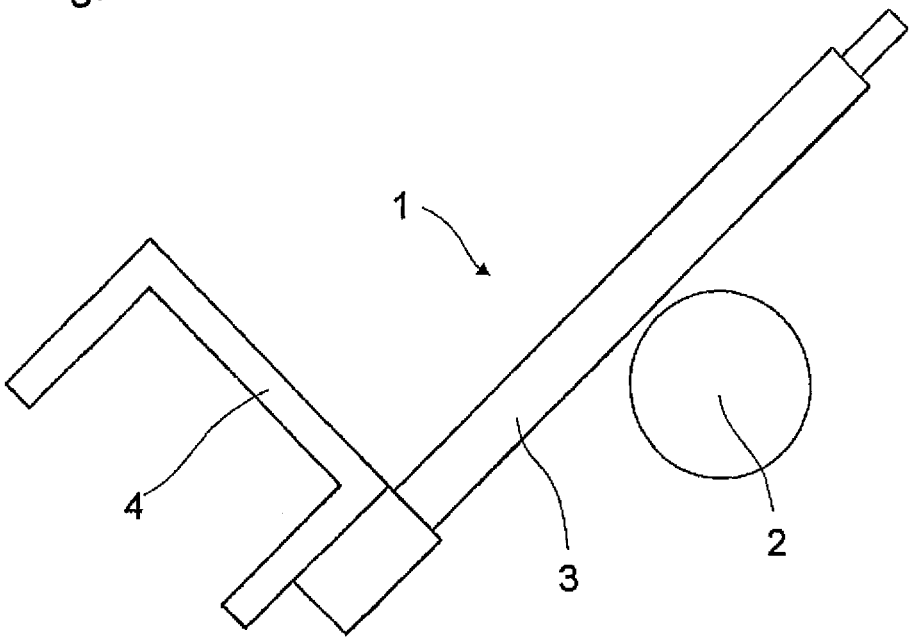
FIG. 1 shows a schematic cross-sectional view of a receiving device of a spinning machine for the drafting arrangement units.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic cross-sectional view of a spinning machine's receiving device 1 for drafting arrangement units 35, 65, 95. The receiving device comprises a drafting arrangement carrier 4 which extends in the longitudinal direction of the machine and which can be, e.g., a profile, in particular an extruded profile or sheet metal profile. On the drafting arrangement carrier 4, second fastening means or second tensioning means 3 are arranged for locking the drafting arrangement unit and for loading the guide arm, respectively. The spinning machine further comprises a driven delivery bottom roller 2 which runs along a plurality of spinning stations, preferably along more than two spinning stations. In a compaction drafting arrangement (not shown in the figures), said delivery bottom roller can also be a driven suction roller. The receiving device forms the basis for receiving drafting arrangement units 35, 65, 95 of different types of drafting arrangements according to the FIGS. 2*a*, 3*a* and 4*a*.

All shown drafting arrangement units 35, 65, 95 have in common that they include a first bottom roller 22, which are held on a base carrier 17, 47, 77 via adequate bearing receptacles. Furthermore, the drafting arrangement unit 35, 65, 95 includes a first top roller 21, 41, 71 and subsequent to the first top roller 21, 41, 71 in the processing direction, a second top roller 19, 49, 79 which corresponds to the delivery top roller. Moreover, the drafting arrangement unit 35, 65, 95 comprises a load device 12, 42, 72 which is connected to the base carrier 17, 47, 77 via a base element 14, 44, 74. The load device 12, 42, 72 further includes a guide arm 13, 43, 73 which is connected to the base element 14, 44, 74 via a pivot joint 15, 45, 75. The first and second top rollers 21, 41, 71; 19, 49, 79 are arranged on the guide arm 13, 43, 73 via bearing receptacles 20, 40, 70; 18, 48, 78.

Furthermore, the drafting arrangement units 35, 65, 95 include first fastening or tensioning means comprising a tensioning lever 16, 46, 76 by means of which, in interaction with the second fastening or tensioning means 3 comprising a guide rod and eccentric means (not shown), the drafting arrangement unit 35, 65, 95 is fastened to the drafting arrangement carrier 4 and the guide arm is loaded.

Figure 2A:
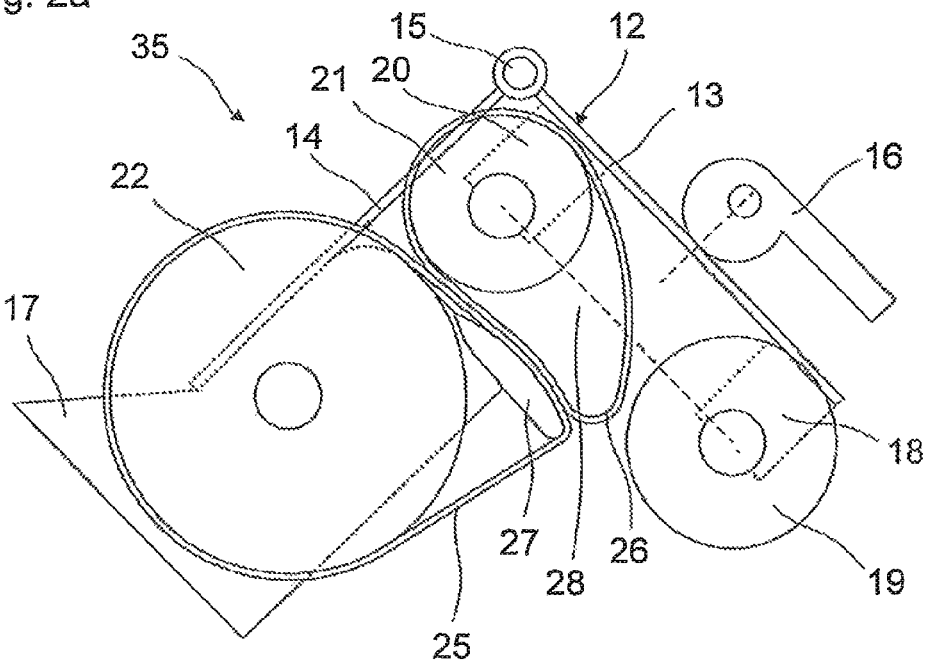
FIG. 2*a* shows a first embodiment of a drafting arrangement unit.
Figure 2B:
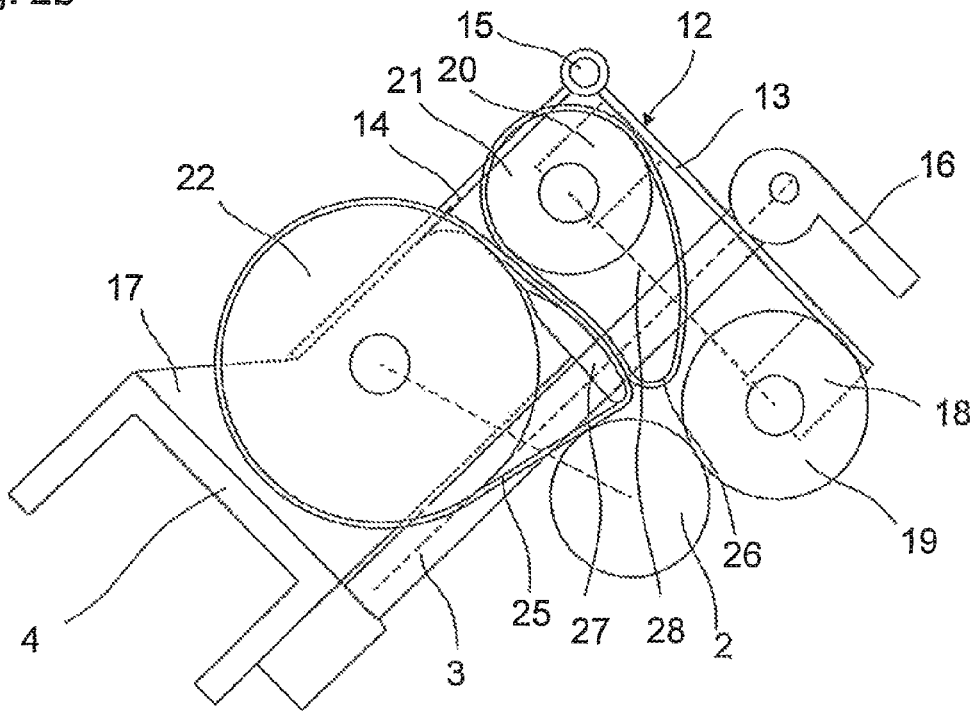
FIG. 2*b* shows a first embodiment of a drafting arrangement unit fastened to the spinning machine.
Figure 3A:
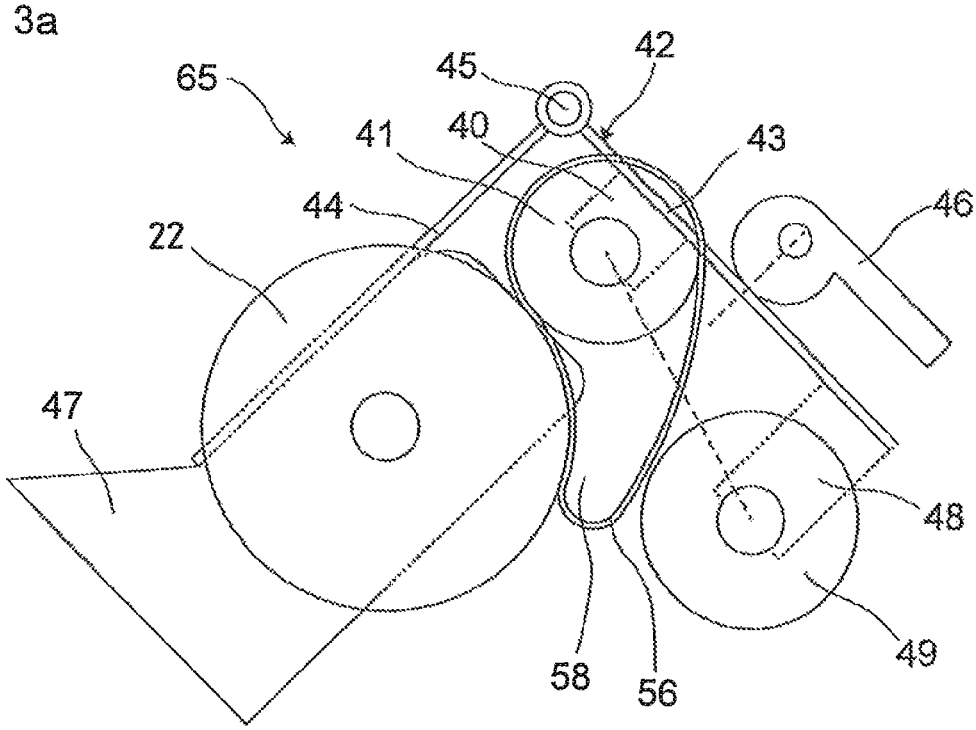
FIG. 3*a* shows a second embodiment of a drafting arrangement unit.
Figure 3B:
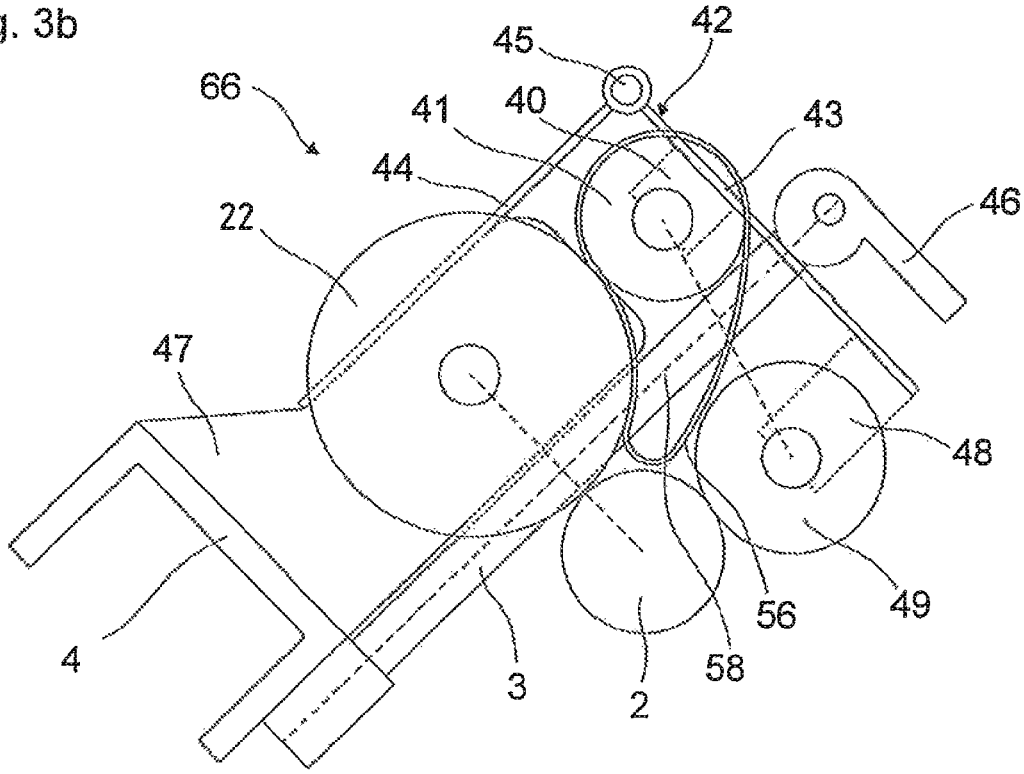
FIG. 3*b* shows a second embodiment of a drafting arrangement unit fastened to the spinning machine.
Figure 4A:
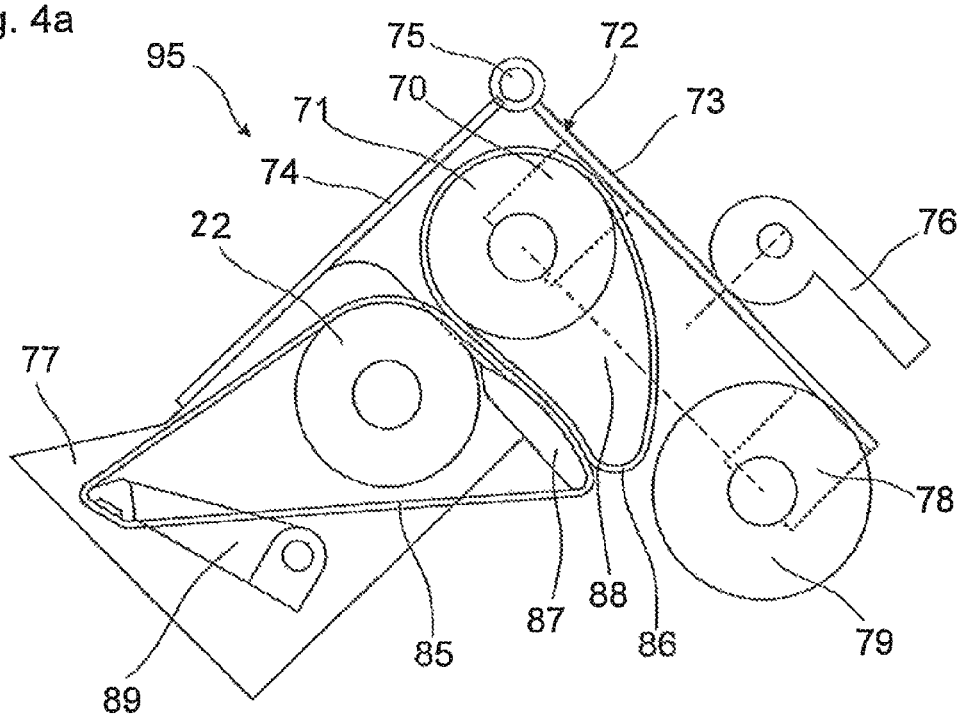
FIG. 4*a* shows a third embodiment of a drafting arrangement unit.
Figure 4B:
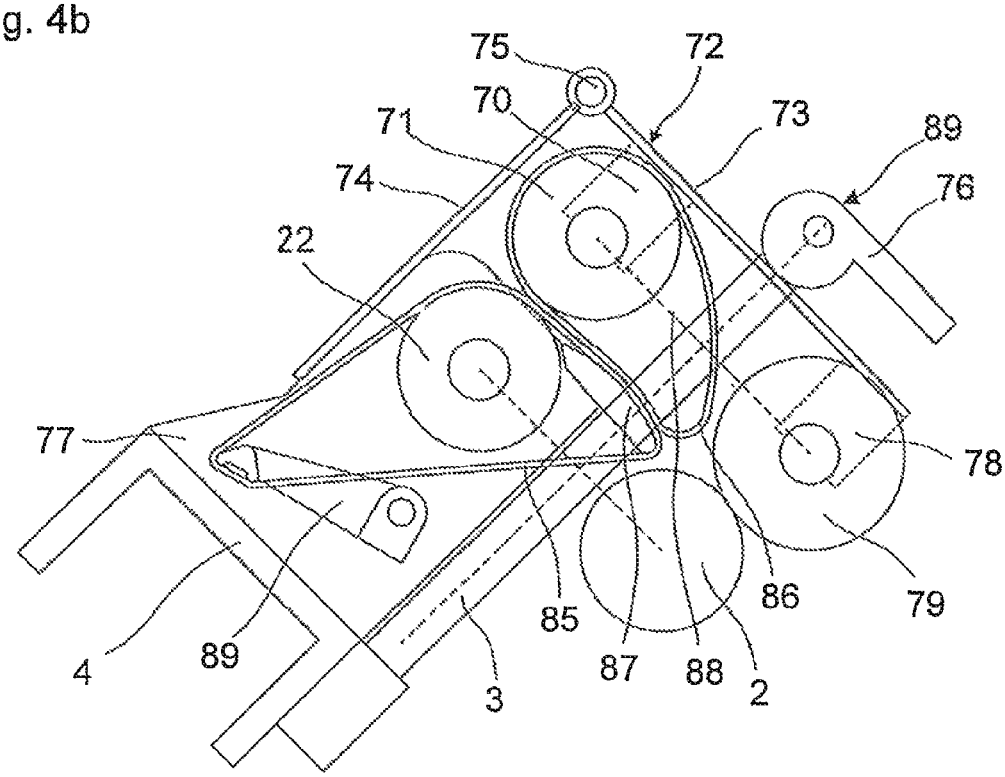
FIG. 4*b* shows a third embodiment of a drafting arrangement unit fastened to the spinning machine.

FIGS. 2*a*, 3*a* and 4*a* show three drafting arrangement units 35, 65, 95, which each have a different type of drafting arrangement and which, however, are compatible to each other with regard to fastening (by means of fastening device) and optionally guiding (by means of guiding device) on the spinning machine. This means, the connecting interfaces between base carrier and drafting arrangement carrier are always compatible to each other despite the different embodiments of drafting arrangements. According to the FIGS. 2*a*, 3*a* and 4*a*, the drafting arrangement units 35, 65, 95 are placed in each case onto the drafting arrangement carrier 4 via the base carrier 17, 47, 77. The guide rod 3 of the fastening or tensioning device reaches in the assembled state of the drafting arrangement unit 35, 65, 95 through a bore in the first tensioning or fastening means. By shifting the tensioning lever 16, 46, 76, the fastening or tensioning device is led into a self-locking position in which the drafting arrangement unit 35, 65, 95 is fixed on the drafting arrangement carrier 4 and the guide arm 13, 43, 73 with the top rollers 21, 41, 71; 19, 49, 79 is loaded. The first top roller 21, 41, 71 rests in the loaded state of the guide arm 13, 43, 73 on the first bottom roller thereby forming a clamping region. The second top roller 19, 49, 70 rests in the loaded state of the guide arm 13, 43, 73 on the second bottom roller 2 on the spinning machine thereby forming a clamping line. Between the first and second pairs of rollers, in each case one main drafting zone is formed.

FIG. 2*a* shows a first embodiment of a drafting arrangement unit 35 which is configured as a double-apron drafting arrangement. The first bottom roller 22 is a large bottom roller 22. The bottom roller 22 is wrapped by a bottom apron 25 which is guided via a deflection bridge 27. A top apron 26, which is guided in a cage 28, is wrapped around the first top roller 21. In the operating position, the top apron 26 and the bottom apron 25 form a fiber guide in the drafting zone. In contrast to conventional double-apron drafting arrangements (see FIG. 4*a*), the present device does not include a bottom apron tensioning apparatus. Furthermore, the bottom apron at the first bottom roller has a considerably larger wrap angle. The described drafting arrangement unit belongs to the third embodiment of the drafting arrangement according to the general part of the description. For further details, reference is made to corresponding embodiments.

FIG. 3*a* shows another embodiment of a drafting arrangement unit 65 which is configured as a Kepa drafting arrangement. The first bottom roller is a large Kepa bottom roller 22 without apron guide. A top apron 56, which is guided in a cage 58, is wrapped around the first top roller 41. The top apron 56 is guided in the cage 58 in such a manner that it runs along a partial circumference and, together with the wrapped partial circumference of the bottom roller, forms a fiber guide in the drafting zone. The described drafting arrangement unit belongs to the second embodiment of the drafting arrangement according to the general part of the description. For further details, reference is made to corresponding embodiments.

FIG. 4*a* shows another embodiment of a drafting arrangement unit 35 which is configured as a conventional double-apron drafting arrangement. The first bottom roller 22 is wrapped by a bottom apron 85 which is guided via a deflection bridge 87. The first top roller 71, on its part, is wrapped by a top apron 86 which is guided in a cage 88. In this manner, bottom and top aprons form a guide via which the sliver is guided in the main drafting zone. The drafting arrangement unit 35 further comprises a tensioning device 89 which is attached to the base carrier 77 and which tensions the bottom apron 85 and provides for a uniform apron guide in this manner. The described drafting arrangement unit belongs to the first embodiment of the drafting arrangement according to the general part of the description. For further details, reference is made to corresponding embodiments.

Figure 2C:
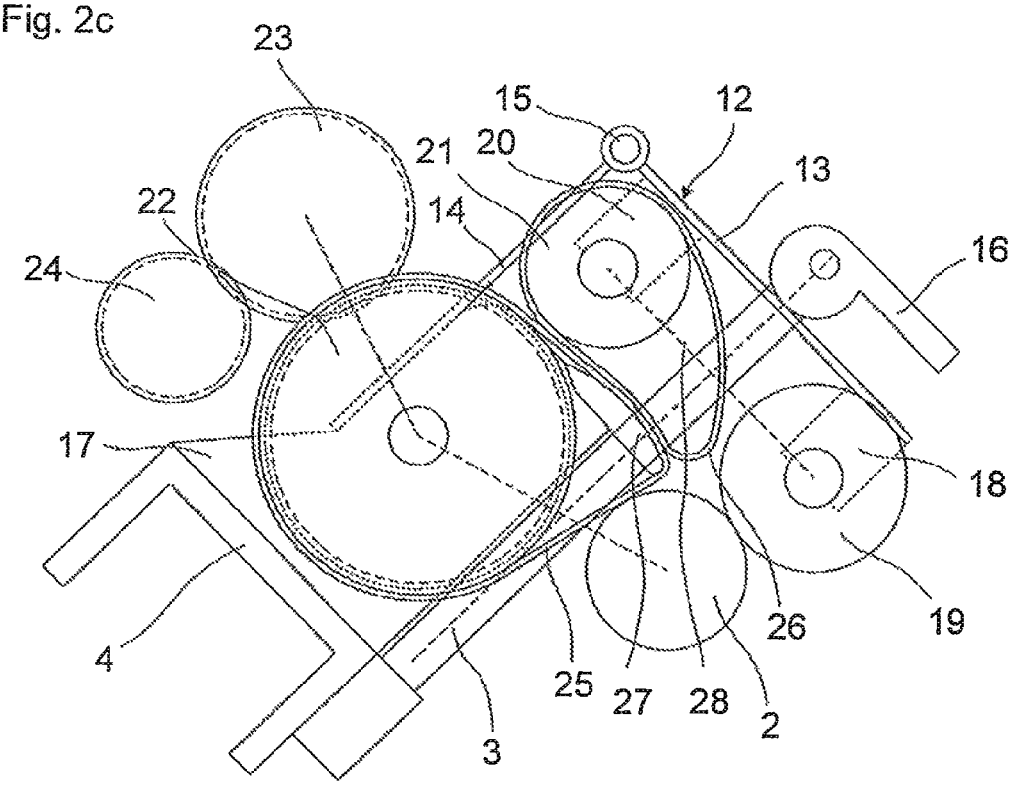
FIG. 2*c* shows a first embodiment of a drafting arrangement unit which is fastened to the spinning machine and comprises a first embodiment for the roller drive.
Figure 3C:
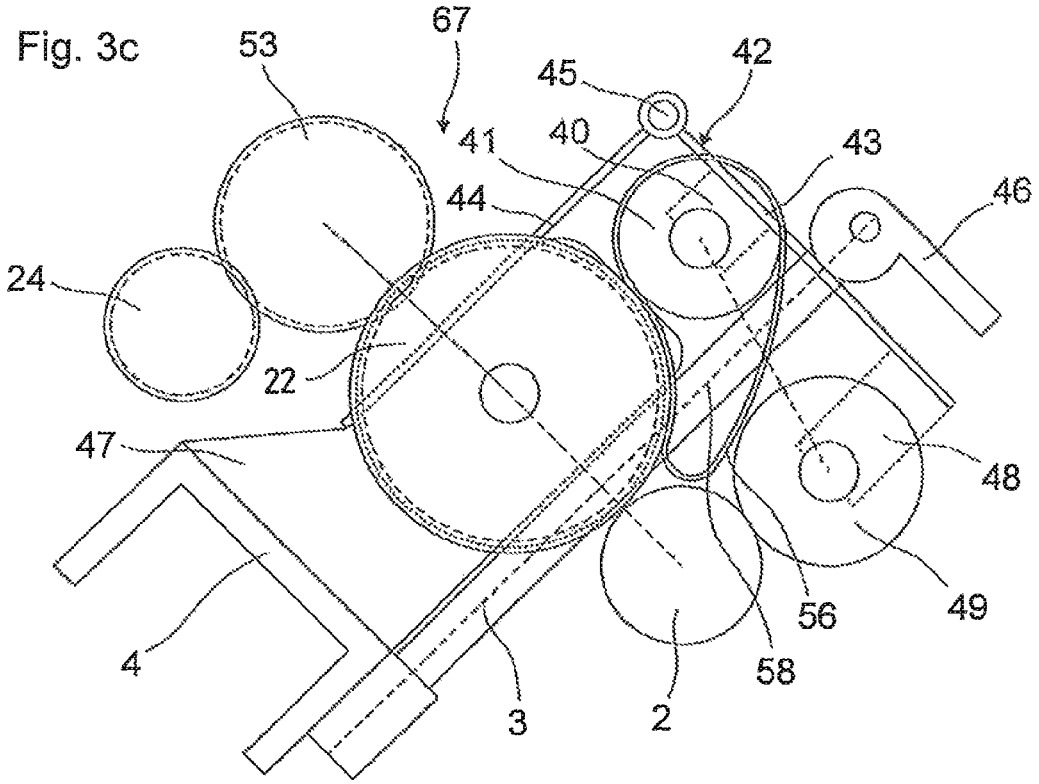
FIG. 3*c* shows a second embodiment of a drafting arrangement unit which is fastened to the spinning machine and comprises a first embodiment for the roller drive.
Figure 4C:
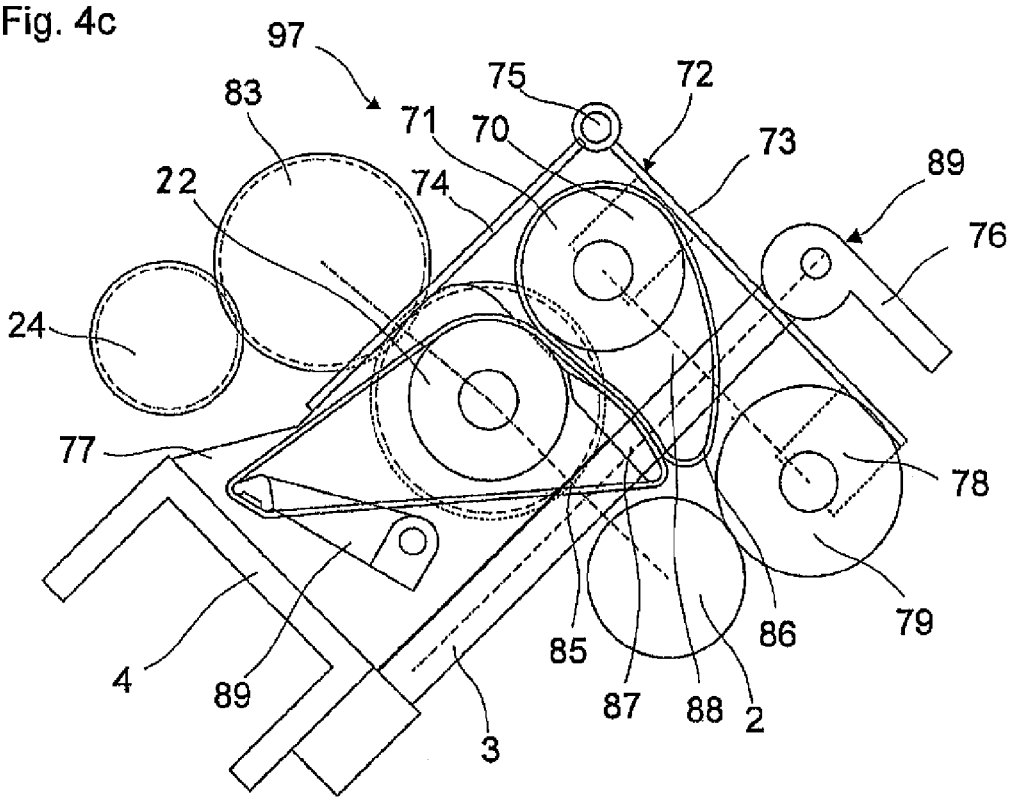
FIG. 4*c* shows a third embodiment of a drafting arrangement unit which is fastened to the spinning machine and comprises a first embodiment for the roller drive.

FIGS. 2*c*, 3*c*, 4*c* and, further, 2*d*, 3*d*, 4*d* as well as 2*e*, 3*e*, 4*e* show in each case different drive concepts for the first bottom roller of the different types of drafting arrangements (38, 67, 68, 97, 98).

The drive concept according to the FIGS. 2*c*, 3*c*, 4*c* provides a central drive shaft 24 which reaches over a plurality of spinning stations, in particular over more than two spinning stations. Via a transmission gearing with gearwheels 23, 53, 83, the torque is received from the drive shaft 24 and transferred to the first bottom roller 22. The first bottom roller 22 is adequately coupled to a tooth system which is in operative connection with the transmission gearing or is a part thereof. Here, the coupling device comprises gearwheels which are engaged with each other. The axes of rotation of the drive shaft and the first bottom roller run parallel to each other.

Figure 2D:
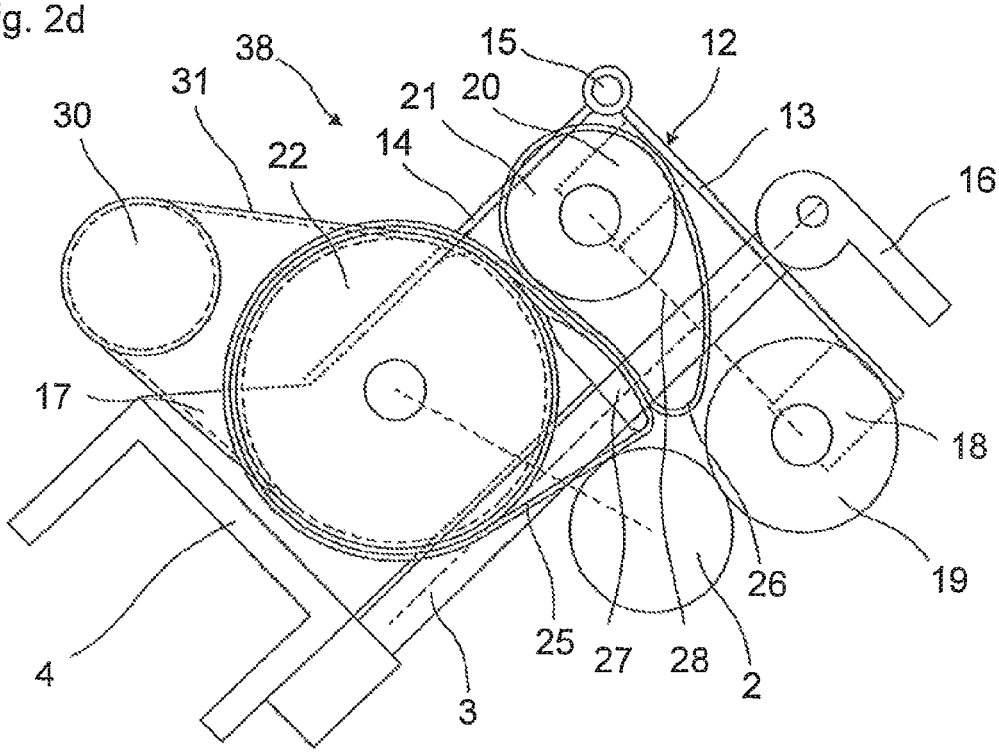
FIG. 2*d* shows a first embodiment of a drafting arrangement unit which is fastened to the spinning machine and comprises a second embodiment for the roller drive.
Figure 2E:
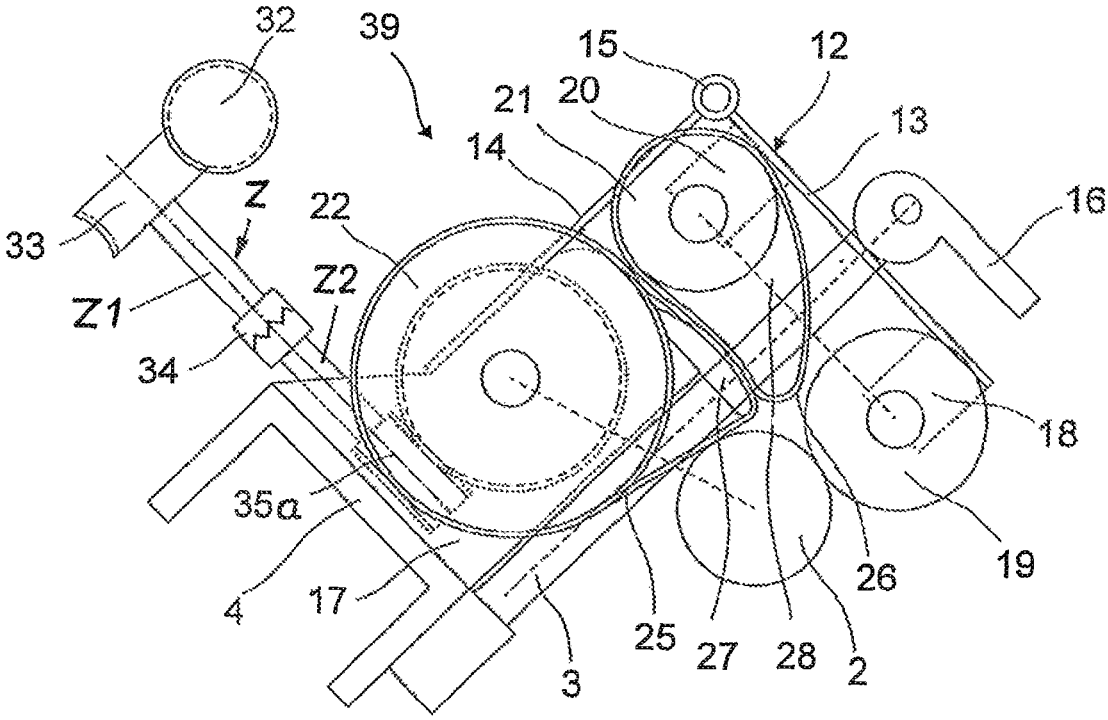
FIG. 2*e* shows a first embodiment of a drafting arrangement which is fastened to the spinning machine and comprises a third embodiment for the roller drive.
Figure 3D:
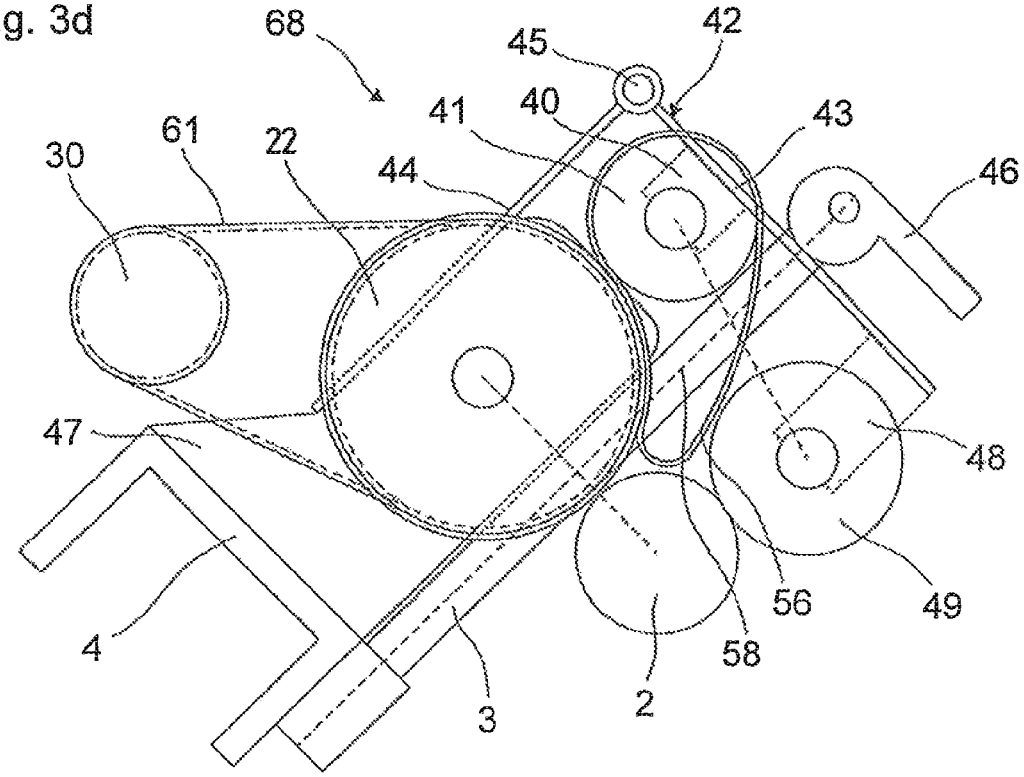
FIG. 3*d* shows a second embodiment of a drafting arrangement unit which is fastened to the spinning machine and comprises a second embodiment for the roller drive.
Figure 3E:
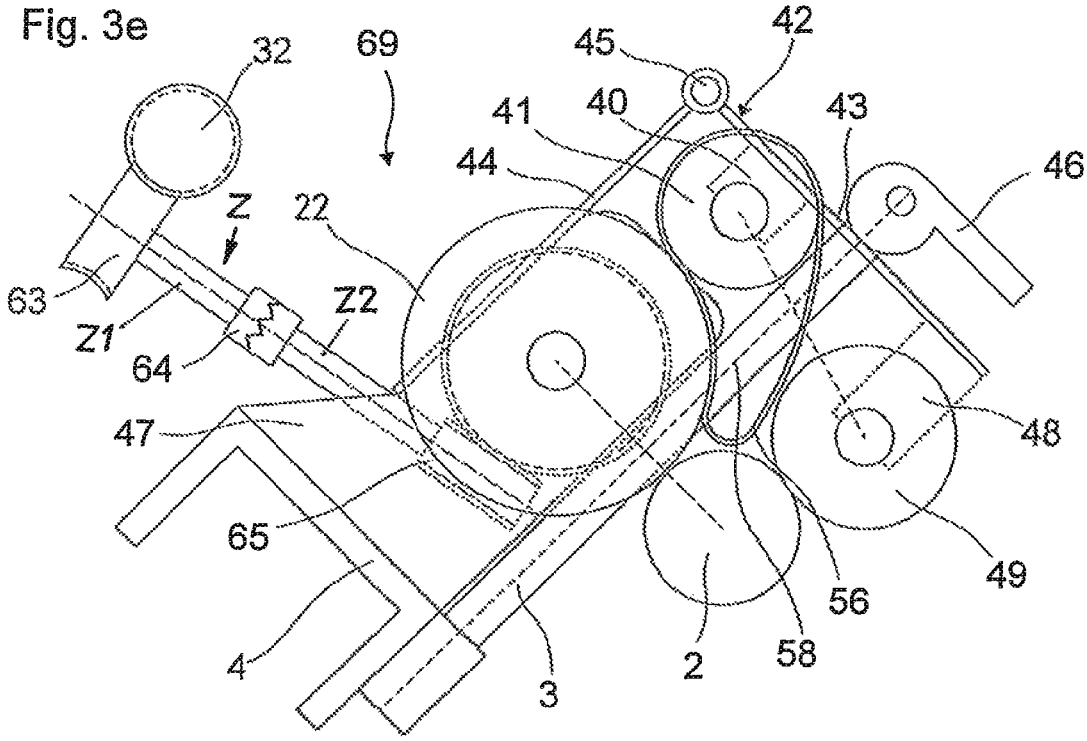
FIG. 3*e* shows a second embodiment of a drafting arrangement which is fastened to the spinning machine and comprises a third embodiment for the roller drive.
Figure 4D:
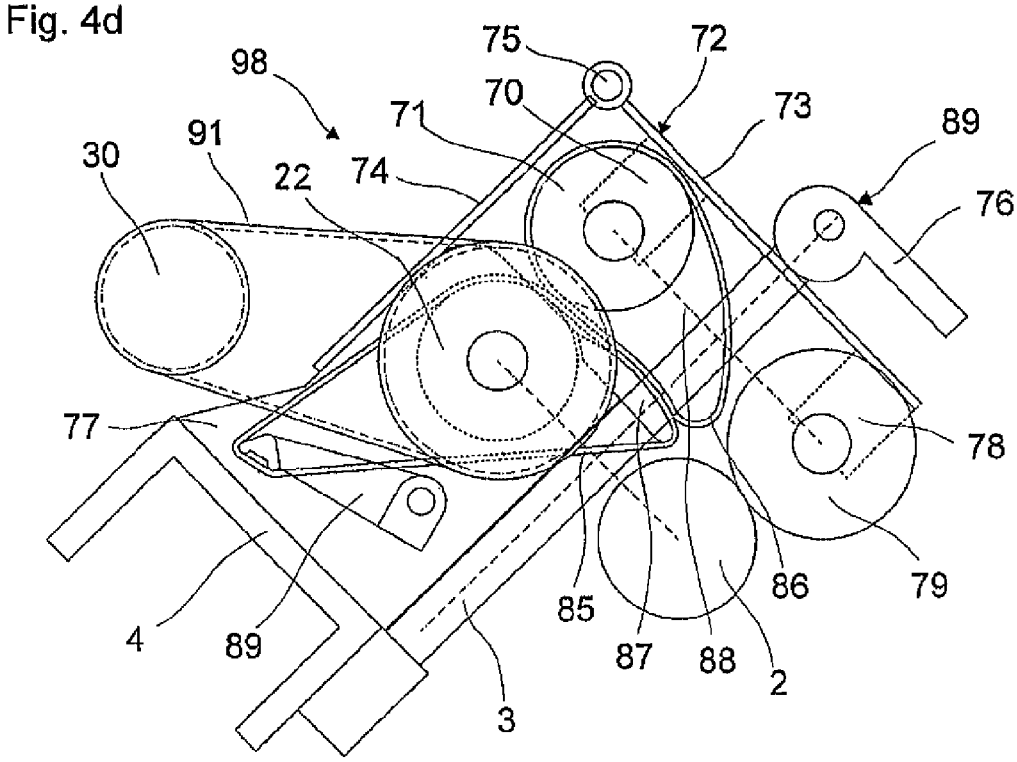
FIG. 4*d* shows a third embodiment of a drafting arrangement unit which is fastened to the spinning machine and comprises a second embodiment for the roller drive.
Figure 4E:
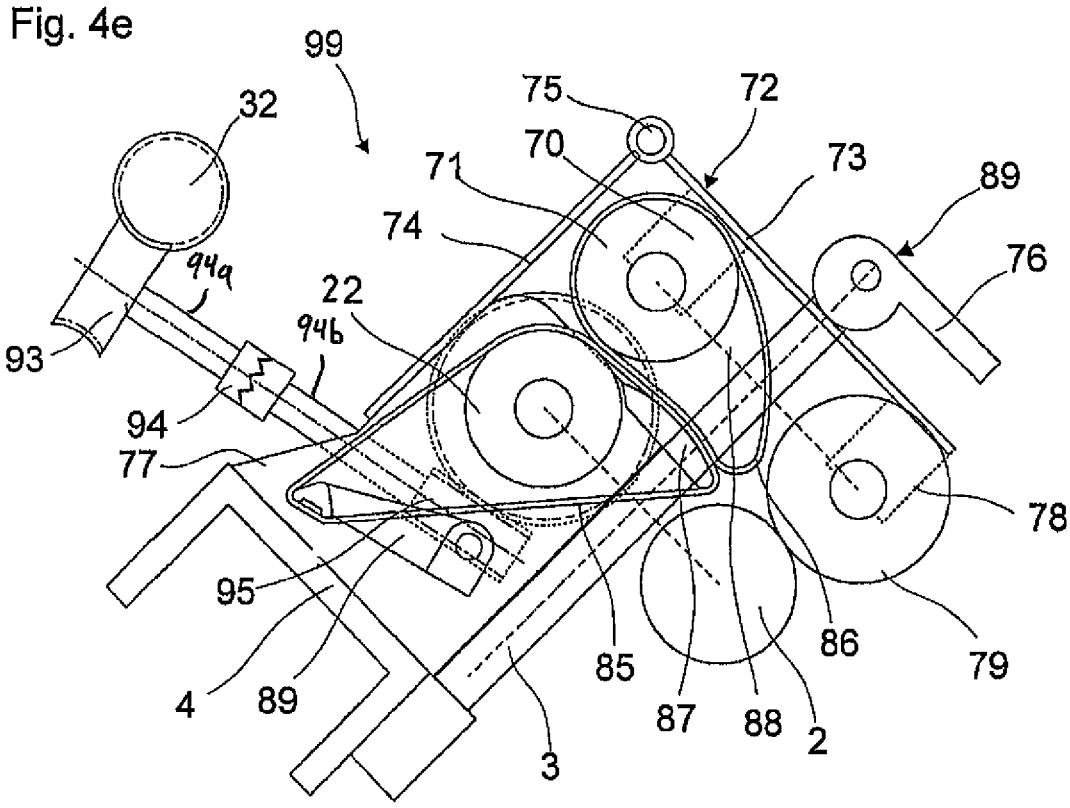
FIG. 4*e* shows a third embodiment of a drafting arrangement unit which is fastened to the spinning machine and comprises a third embodiment for the roller drive.

The drive concept according to the FIGS. 2*e*, 3*e*, 4*e* provides a central drive shaft 32 which reaches over a plurality of spinning stations, in particular over more than two spinning stations. The torque is received from the drive shaft 32 via a worm gear and fed to the first bottom roller 22. The worm gear comprises a first worm gear device 33 via which the torque is transmitted from the drive shaft 32 to an intermediate shaft arranged transverse to the drive shaft. By means of a second worm gear device 35*a*, the torque is transmitted from the intermediate shaft to the first bottom roller 22, the rotational axis of which, in turn, runs transverse to the intermediate shaft and in particular parallel to the drive shaft. The first bottom roller 22 is adequately coupled to a tooth system which is in operative connection with the second worm gear device. The intermediate shaft is separated in two parts by a positive-locking coupling 34. That part of the intermediate shaft that is connected to the first worm gear device 33, 63, 93 is secured on the spinning machine. That part of the intermediate shaft Z that is connected to the second worm gear device is part of the drafting arrangement unit 39, 69, 99. When fitting the drafting arrangement unit 39, 69, 99 onto the spinning machine, the two portions Z1, Z2 of the intermediate shaft Z are connected to each other via the coupling 34, 64, 94. Here, the coupling 34 (FIG. 2*e*) consists of separable coupling means 34*a* and 34*b*, wherein the coupling means 34*a* is fixedly connected to the intermediate shaft portion Z1 and the coupling means 34*b* is fixedly connected to the intermediate shaft portion Z2. The same applies to the further exemplary embodiments of FIG. 3*e* and FIG. 4*e* with the selected other reference numbers of the couplings 64, 94.

The drive concept according to the FIGS. 2*d*, 3*d*, 4*d* provides a central drive shaft 30 that reaches over a plurality of spinning stations, in particular over more than two spinning stations. Via a toothed belt drive 31, 61, 91, the torque is received from the drive shaft 30 and fed to the first bottom roller 22. The first bottom roller 22 is adequately coupled to a tooth system which is in operative connection with the toothed belt drive 31, 61, 91 or is a part thereof. The coupling device comprises here toothed belt and gearwheel. The rotational axes of the drive shafts and the first bottom roller run parallel to each other.

Figure 5A:
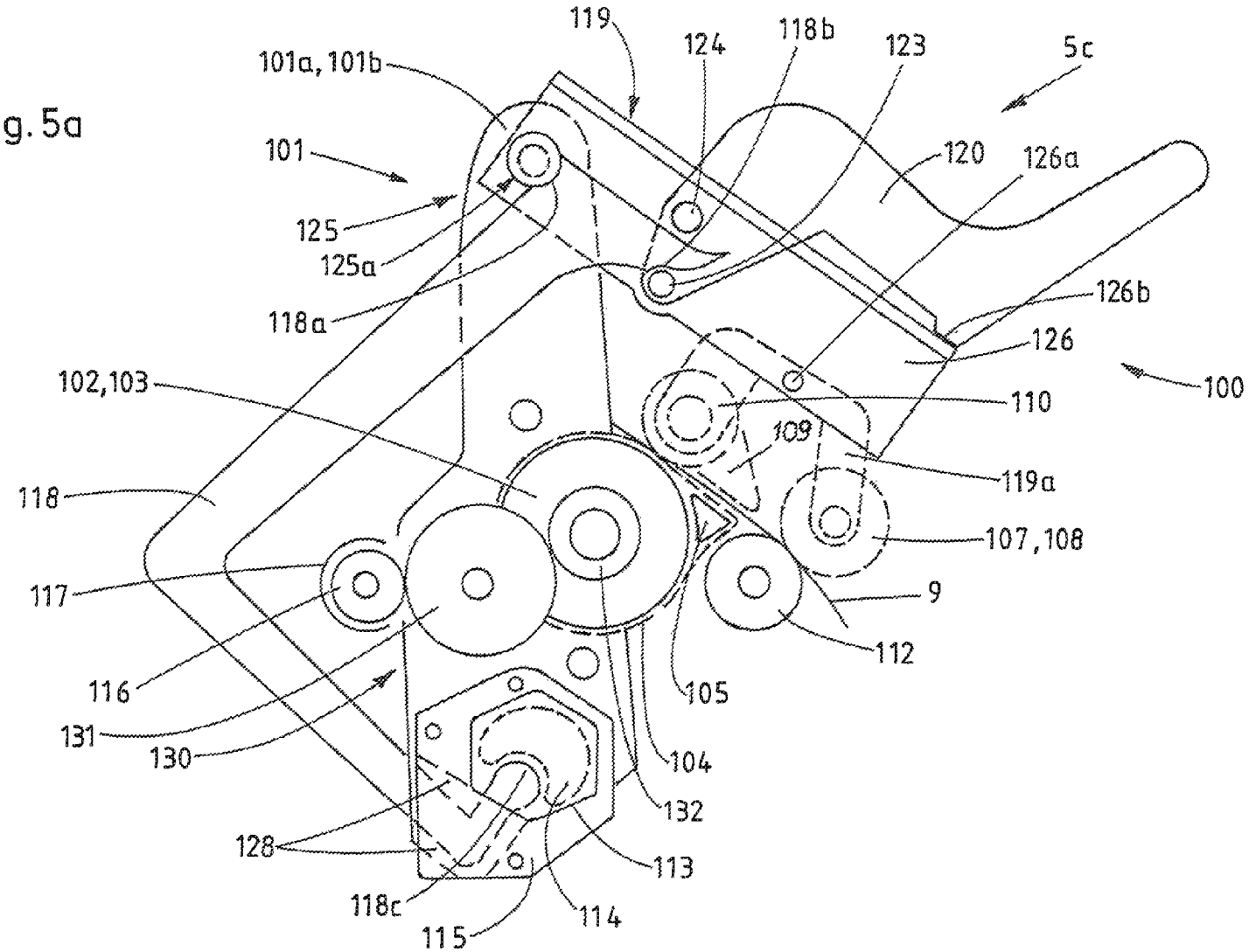
FIG. 5*a* shows a fourth embodiment of a drafting arrangement unit.
Figure 5C:
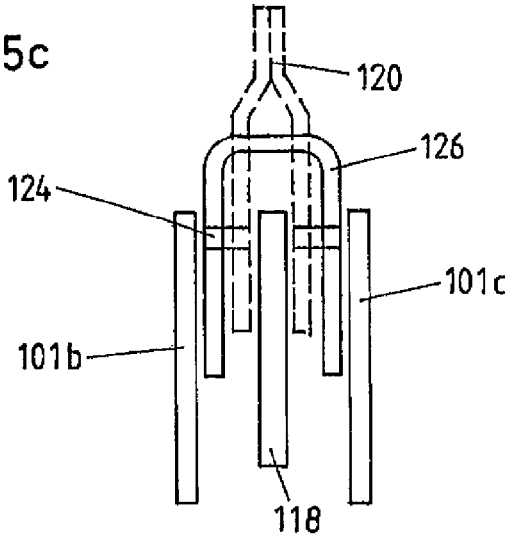
FIG. 5*c* shows a side view of the embodiment according to FIG. 5*a;*
Figure 5B:
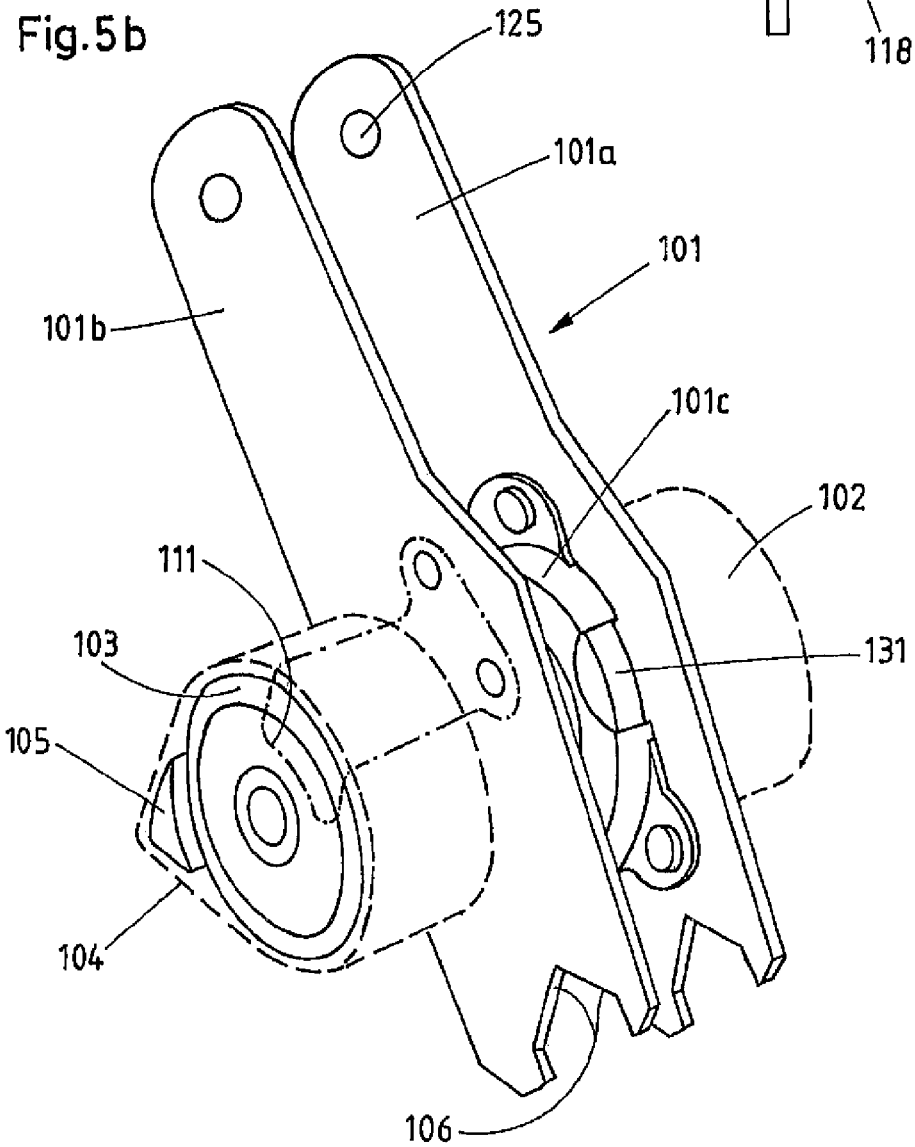
FIG. 5*b* shows a detailed cut-out from the embodiment according to FIG. 5*a;*

The drafting arrangement unit 100 according to FIG. 5*a* includes at least one base carrier or a multi-piece base carrier 101 which includes two plane elements 101*a*, 101*b*, e.g. punches, which are arranged spaced apart and next to each other in an upright position and are connected to each other via a connecting element 101*c*: see also FIG. 5*b* and FIG. 5*c*. Within the element 101*c*, a portion of the idler wheel 131 can be seen.

According to FIG. 5*c*, side view in the direction of the arrow 5*c* of the embodiment in FIG. 5*a*, the lock lever 120 is forked between 2 base carriers 101*a*, 101*b* and connected to the guide arm 126 by means of 2 axles 124, wherein the pressure arm 118 is positioned between the mentioned parts.

A drafting arrangement unit 100 can be configured as a twin drafting arrangement unit for two adjacent working positions. Two bottom rollers 102, 103, which are connected to each other via a connecting axle, are held on the base carrier 101 via suitable bearing receptacles. For this purpose, the plane elements 101*a*, 101 have openings. The bottom rollers 102, 103, which are configured as large bottom rollers according to an above-described embodiment of a drafting arrangement, are in each case wrapped by a bottom apron 104 that is guided via a deflection bridge 105. The bottom apron 104 is held on the bottom roller 103 by a lateral guide 111 which likewise is secured on the base carrier 101, and is prevented from slipping sideways. The first top rollers 110 of a pair of top rollers are in each case wrapped by a top apron (not shown) that is guided in a cage 109. The sliver (not shown) is guided between top and bottom aprons in a main drafting zone.

Principally, the drafting arrangement unit 101 shown can also comprise a different type of drafting arrangement, e.g., a Kepa drafting arrangement or a conventional apron drafting arrangement with apron tensioning device.

The drafting arrangement unit 100 is placed via a support surface 106 of the base carrier 101 onto a drafting arrangement carrier 113 which is formed as a hexagonal tubular profile and extends in the longitudinal direction of the spinning machine. The spinning machine further comprises a delivery bottom roller 112 which extends over a multiplicity of spinning stations and which can also be a suction drum of a compacting device. The bottom delivery roller 112 together with the top outfeed rollers 107, 108 forms the pair of delivery rollers.

The drafting arrangement unit 100 further comprises a load device 119 with a guide arm 126 which is rotatably mounted via a pivoting connection 125 on the upper end portion of the plane elements 101*a*, 101*b*. A lock lever 120 is pivotably secured on the guide arm 126. The load device 119 is in operative connection with a pressure arm 118 which likewise is rotatably secured on the upper end portion of the plane elements 101*a*, 101*b*. However, the pressure arm can just as well be rotatably mounted on a component of the spinning machine.

The spinning machine includes a pneumatic pressure device 114 which comprises a pneumatic flexible tube which is guided in the cavity of the drafting arrangement carrier 113. Via a pressure thumb 118*c* located at its end, the pressure arm 118 is in operative connection via an intermediate device 115 with the pressure device 114. The operative connection between the pneumatic pressure device 114, the pressure arm 118 and the guide arm 119 is now explained in more detail below.

For closing the drafting arrangement, the guide arm 126 is lowered downward by a pivoting movement of the lock lever 120 about the pivot point 124. In the course of this, the two pairs of top rollers are placed onto their corresponding bottom rollers 102, 103; 112. When lowering the lock lever 120, a cam 123 on the lock lever 120 snaps into an indentation on the pressure arm 118 upon passing a pressure point with the lock lever being pressurized so that in the closed position of the guide arm 110, self-locking is implemented. The top rollers 110; 107, 108 now rest on the bottom rollers 102, 103; 112. By means of the pressure device 114, the load of the top rollers 110; 107, 108 acting on the bottom rollers 102, 103; 112 can be adjusted via the pressure arm 118. For this purpose, the pressure flexible tube belonging to the pneumatic pressure device 114 is expanded. Due to the cross-sectional expansion of the hose, pressure is exerted on a pressure thumb 118*c* which is engaged with the pressure arm 118 or is connected to the same, whereby the pressure arm 118 is deflected and transmits the deflection pressure via its indentation 118*b* to the cam 123. Thereby, the guide arm and thus the top rollers 110; 107, 108 are pressed harder onto the bottom rollers 102, 103; 112. Thus, during the spinning operation, the guide arm 119 is additionally loaded through the pressure device 114. During a standstill of the machine, the guide arm 119 is depressurized through pressure relief in the pressure flexible tube so that the flexible tube is only loaded by self-locking. In this way, deformation of the top rollers 110; 107, 108 during long downtimes is avoided. Since the centrally controlled pressure device 114 extends over a multiplicity of spinning stations, the spinning stations connected to the pressure device can be jointly pressurized or depressurized from a single central point. However, establishing self-locking takes place individually for each spinning station or pair of spinning stations.

The first bottom roller 103 is driven on the spinning machine by a shaft 116 which extends over a plurality of spinning stations. The shaft 116 is accommodated in a protective manner in a shaft housing 117. The torque is transmitted via a gearing arrangement from the shaft 116 to the bottom rollers 102, 103. For this purpose, the shaft housing 117 has openings (not shown) into which gearing elements extend in order to transmit torque to the first bottom roller 102, 103. Here, the coupling device is part of the gearing arrangement. The connecting element 101*c* according to FIG. 5*b* is formed as a housing part which accommodates or holds gearing elements, such as gearwheels, of the gearing arrangement. In the exemplary embodiment according to FIG. 5*a*, the shaft 116 is connected via an idler wheel to a driven wheel 132 which is connected coaxially and rotatably fixed to the bottom roller(s) 102, 103, wherein the mentioned gearing elements can be configured as gearwheels. Instead of a shaft 116 which, for its part, has an electric drive, it is also possible to provide a driven wheel 116 of an electric motor which is only responsible for a small number of spinning stations. In a long spinning machine, a multiplicity of such motors has to be arranged. The transmission ratio between the shaft or the driven wheel 116 and a bottom roller 102, 103 is to be selected such that the former, the element 116, rotates at least four times faster than the bottom roller 102 so that the shaft 116 or the electric motor at the driven wheel 116 can be dimensioned rather small.

According to FIG. 5*a*, a drafting arrangement unit according to the invention is divided into a lower part with support surfaces 106 for a drafting arrangement carrier 113 in the spinning machine, further, into a middle part with a gearing 130 on a bottom roller 102, 103, and an upper part with a pivoting connection 125 for a load device 119. The load device 119 is pivotably connected in the pivoting connection 125 to the base carrier 101 of the drafting arrangement unit 100 by means of an axle 125*a*. However, also part of the load device is a pressure arm 118 which, as a lever that is bent or curved multiple times, has an indentation 118*b* on its upper end, which indentation interacts with a cam 123 of the lock lever 120, which lock lever is pivotably mounted in a pivot point 124 on a guide arm 126 of the load device 119. At its first upper bending or curvature near the indentation 118*b*, the pressure arm 118 has another indentation 118*a* by means of which the pressure arm can be supported on the base carrier 101, 101*a*, 101*b*, in particular on the axle 125*a* of the base carrier, when closing the load device 119. In its middle portion, the pressure arm 118 is cranked or curved in order to leave some free space for the drive element 116, in particular a shaft or a motor, for the drafting arrangement device and for a shaft housing 117. In the lower part, the pressure arm 118 is once again bent or curved, wherein at the end of the bending, a so-called pressure thumb 118*c* is seated, which is pressurized by the pressure device 114 within the drafting arrangement carrier 113. According to FIG. 5*a*, the lower part of the pressure arm 118 is guided in a pocket 115 which surrounds the pressure arm 118 in this area in such a manner that the pressure arm 118 can move to a minor extent within the cavity 128 of the pocket and thus the pressure thumb 118*c* can move on the drafting arrangement carrier 113 within a border area so that the pressure arm can perform its function for maintaining a clamping effect in the load direction 119 and for additionally loading the bottom roller 102, 103 and also the bottom delivery roller 112. The pocket 115 is fastened next to a base carrier 101*a*, 101*b* to the drafting arrangement carrier 113. The pressure arm is fitted on the spinning machine, preferably on the drafting arrangement carrier, with the aid of the pocket 115, independent of the load device 119 with the guide 126 and the lock lever 120 as well as the top delivery rollers 107, 108. The support surfaces 106 of the base carrier 101 according to FIG. 5*b* are configured such that the drafting arrangement unit 100 can be pulled upward off the drafting arrangement carrier 113 and can be placed downward onto this carrier. In the operating position of the drafting arrangement unit, the upper bent or curved part of the pressure arm is inserted at its end between the pivot point 124 and the cam 123 of the lock lever 120, and, at the lower end of the guide arm 126, the lock lever 120 rests with a projection 126*b* on said guide arm, wherein said lower end is located close to the top delivery roller 107, 108 of the load device. The top delivery roller 107 as well as another top roller 110, which rests against the bottom roller 102 in the operating position, is pivotably and adjustably secured on the guide arm 126 via a carrier 119*a* by means of the axle 126*a*. Thus, in the closed state of the load device 119, when the projection 126*b* of the lock lever abuts against the guide arm, the indentation 118*a* of the pressure arm 118 rests against the outer side of the first upper bending or curvature according to FIG. 5*a* on the base carrier 101, in particular against the axle 125*a* of the base carrier or base carriers 101*a*, 101*b*. Furthermore, in the course of this, the cam 123 on the lock lever 120 lies in the indentation 118*b* of the pressure arm 118.

In a preferred embodiment, the drafting arrangement of the spinning machine includes a removable drafting arrangement unit 100 with a bottom roller 102 with a gearing 130 on a base carrier 101 which rests on a drafting arrangement carrier 113, furthermore, a load device 119 with top rollers 107, 110 which are rotatably secured on the base carrier 101, further, a pressure arm 118 for pressurizing the load device 119 and, at the same time, for positively fixing the drafting arrangement unit 101 on the drafting arrangement carrier 113, as well as a drive element 116 for the bottom roller 102 and a bottom delivery roller 112 with a drive, wherein drive element 116 and bottom delivery roller 112 are arranged on the drafting arrangement unit 100 or are arranged stationarily in the spinning machine. The pressure arm 118 is pressurized by a pressure device 114, which is accommodated stationarily in the spinning machine, and acts in such a manner on a lock lever 120 of the load device 119 that a torque is generated on the lock lever 120 and thus on the load device 119, which torque presses the top rollers 107, 110 against the bottom rollers 102, 112.

In general, the pressure arm 118 forms a clamp which, at the upper end at the application point of force, exerts at the indentation 118*b* a force transverse to the path of the sliver 9, thus transverse to the connecting line of the clamping points of the bottom roller 102 with the top roller 110 and the bottom delivery roller with the top delivery roller 107, which force is counteracted at the lower end with the pressure thumbs 118*c* by a $2^{nd}$ force which is transmitted from the pressure device 114 to the pressure thumb, wherein these two forces, together with a further reaction force between pressure arm 118 and the base carrier 101, form a closed triangle of forces in the pivoting connection 125.

It goes without saying that the exemplary embodiments according to FIGS. 1 to 5 are also applicable to single-motor drives. In particular, the described construction of base carrier, load device, drafting arrangement, drafting arrangement rollers with their apron arrangements and apron guides etc. are also applicable to single-motor drives.

With regard to the desired interchangeability of drafting arrangement units on the spinning machine, the drive interfaces developed within the context of a drive concept are compatible with each other, independent of the type of drafting arrangement implemented on the drafting arrangement unit. The drive interface comprises, among other things, the coupling device.

The invention further relates to a combination of a machine for producing roving, hereinafter called air jet roving frame, and a spinning machine with drafting arrangement units, and to a method for producing yarns by using the mentioned combination.

According to the prior art, the so-called roving frame is usually used as a preliminary spinning machine, which produces the accordingly mentioned roving. Said preliminary spinning machine is equipped with a drafting arrangement and a spindle for winding the roving onto a cylindrical bobbin by means of a flyer for supporting the roving with respect to the centrifugal force caused by the spindle speed. In particular, due to the complicated winding mechanism, said roving frame is an expensive machine within the entire spinning process. Moreover, the usual capacity of a roving frame is approximately 20 to 25 meters of roving per minute. However, this low production cannot be increased with regard to the winding system with flyers because a higher speed is limited by the centrifugal force which the flyers and the roving bobbin have to withstand.

It is another object of the present invention to provide a preliminary spinning machine and a method for producing roving with which the mentioned disadvantages of conventional preliminary spinning machines are avoided and with which a uniform yarn is produced that can be processed without break draft in a drafting arrangement.

Figure 6:
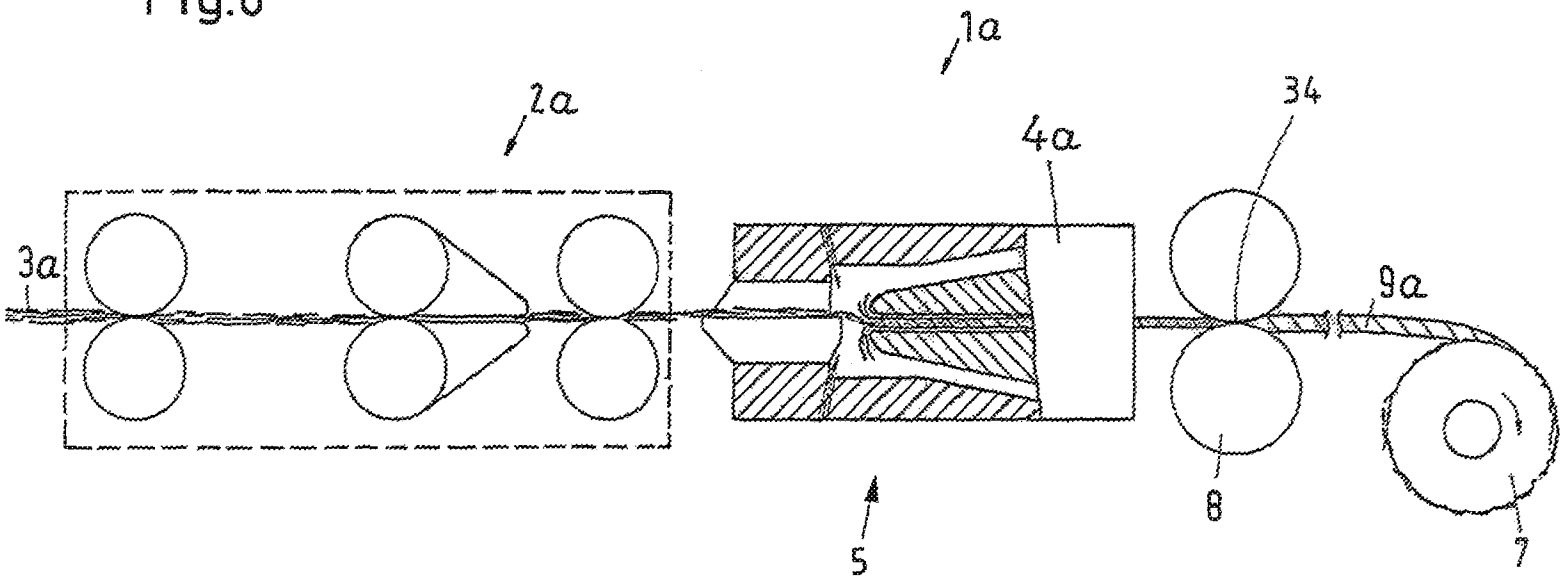
FIG. 6 shows a device for producing roving, which can be combined with a spinning machine comprising drafting arrangements.

FIG. 6 shows schematically a spinning station 1 of a preliminary spinning machine for producing roving that can be advantageously processed without break draft with the drafting arrangement units according to the invention. The drafting arrangement 2*a* of the preliminary spinning machine is supplied with a fiber strand 3, for example, a doubled drafting arrangement sliver. From the drafting arrangement, the drafted fiber strand 3 subsequently gets into a twisting means 4*a*. In the twisting means 4*a*, the fiber strand 3 is twisted into a roving 9*a*, i.e., the fiber strand is at least partially provided with a real twist. Moreover, FIG. 6 shows a pair of detaching rollers 8 with a clamping line 34, and a winding apparatus 7 for the roving 9*a*. In addition to the drafting arrangement 2*a* or instead of the drafting arrangement 2*a*, an actual conventional drawing frame can be provided within the same machine. Such a drawing frame-roving machine combination has the advantage of a shortened process.

The twisting means 4*a* operates according to a special air-jet spinning method. The latter is known per se as a yarn spinning method. Surprisingly and in an unexpected manner, tests with suitably modified air-jet spinning apparatuses have shown that certain air-jet spinning methods are also suitable for producing rovings. However, for this purpose, the dimensions and the flow conditions of conventional yarn air-jet spinning apparatuses have to be adjusted. The twisting means according to the invention have to give the fiber strand only a protective twist so that the sliver or roving formed in this manner remains easily draftable. The usual conventional air-jet apparatuses twist the fiber strand in such a manner that a yarn or a thread is formed that is tightly twisted in such a manner that the twist is irreversible and therefore can no longer be drafted. Through appropriately larger dimensions of the air-jet apparatuses and by adjusting the flow conditions, and primarily through suitably high delivery speeds, it is also possible to produce draftable ravings or slivers with air-jet apparatuses.

According to tests, air-jet spinning apparatuses for rovings preferably have one or a plurality of the following properties:

- the diameter of the twist or whirling chamber is at least 5 mm (see whirling chamber 5 in FIG. 6)
- the delivery speed of the fiber strand (from the delivery rollers of the drafting arrangement onwards) is at least 200 m/min
- the pressure of the air flow prior to flowing through the jet nozzle bores or jet nozzles into the whirling chamber is not more than 5 bar
- these air-jet apparatuses give the roving or the sliver a small wrapping twist; preferably, the twist coefficient $\alpha_m$ is smaller than 100.

Such an air-jet spinning apparatus for rovings is described in the publication WO 2005/026421 A1. The uniform yarn produced therewith can be advantageously processed without break draft with spinning machines comprising the described drafting arrangement units.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

The invention claimed is:

1. A drafting arrangement unit for configuration with one or more spinning units of a spinning machine, comprising:

a first top roller;

a first bottom roller rotatably mounted on a base carrier, the base carrier attachable to a drafting arrangement carrier on the spinning machine;

the first top roller and first bottom roller defining a first pair of rollers having a clamping region;

the first top roller fastened to the base carrier via a pivotable guide arm of a load device;

a fastening device configured to detachably mount the drafting arrangement unit to the spinning machine adjacent the one or more spinning units;

the base carrier further comprising a first guiding device that interacts with a second guiding device on the drafting arrangement carrier on the spinning machine to position and align the drafting arrangement unit on the spinning machine;

a tensioning device configured to load the guide arm relative to the spinning machine, the tensioning device comprising a first tensioning component that interacts with a second tensioning component on the spinning machine; and the tensioning device also configured as a component of the fastening device, wherein locking the drafting arrangement unit on the spinning machine and loading the guide arm are carrier out at least in part via the tensioning device.

2. The drafting arrangement unit as in claim 1, wherein the second tensioning component comprises a pivotally mounted pressure arm connected to a pressure device on the spinning machine, wherein when the first and second tensioning components are operably connected, the tensioning device presses the top roller against the bottom roller and is self-locking in the operably connected position.

3. The drafting arrangement unit as in claim 1, wherein the drafting arrangement unit is configured as a twin drafting arrangement unit for two adjacent spinning stations on the spinning machine.

4. The drafting arrangement unit as in claim 1, further comprising coupling means for coupling the first bottom roller with a drive shaft on the spinning machine to transmit rotational torque to the first bottom roller.

5. The drafting arrangement unit as in claim 1, further comprising a motor drive configured to drive at least one the first bottom roller of the first pair of rollers.

6. The drafting arrangement unit as in claim 1, wherein the base carrier comprises at least two adjacent, spaced-apart plane elements oriented in an upright position and connected via a connecting element.

7. The drafting arrangement unit as in claim 1, wherein the base carrier comprises a support surface that engages with the drafting arrangement carrier on the spinning machine formed as a hexagonal, tubular member extending in the longitudinal direction of the spinning machine.

8. A spinning machine, comprising:

a plurality of spinning adjacently disposed spinning stations;

a drive shaft extending along the spinning stations;

a detachable drafting arrangement unit configured with at least one of the spinning stations, the drafting arrangement unit further comprising:

a first top roller;

a first bottom roller rotatably mounted on a base carrier, the base carrier attached to a drafting arrangement carrier on the spinning machine;

coupling means for coupling the first bottom roller with the drive shaft to transmit rotational torque to the first bottom roller;

the first top roller and first bottom roller defining a first pair of rollers having a clamping region;

the first top roller fastened to the base carrier via a pivotable guide arm of a load device;

a fastening device configured to detachably mount the drafting arrangement unit to the spinning machine adjacent one or more of the spinning stations;

the base carrier further comprising a first guiding device that interacts with a second guiding device on the drafting arrangement carrier to position and align the drafting arrangement unit on the spinning machine;

a tensioning device configured to load the guide arm relative to the spinning machine, the tensioning device comprising a first tensioning component that interacts with a second tensioning component on the spinning machine; and the tensioning device also configured as a component of the fastening device, wherein locking the drafting arrangement unit on the spinning machine and loading the guide arm are carrier out at least in part via the tensioning device.

9. The spinning machine as in claim 8, wherein the spinning machine is one of an air-jet spinning machine, a ring spinning machine, a funnel spinning machine, a loop spinning machine, a pot spinning machine, or a roving machine that produces a roving from a fiber strand.

10. The spinning machine as in claim 8, wherein the drafting arrangement unit is divided into a lower part having support surfaces that interact with the drafting arrangement carrier, a middle part comprising a gearing engaged with the bottom roller, and an upper part with a pivoting connection for the load device.

11. The spinning machine as in claim 8, wherein the tensioning device comprises a pivotally mounted pressure arm having an indentation at an upper portion thereof, and a lock lever pivotally mounted on the guide arm, the lock lever including a cam that engages in the indentation and a projection that rests on the guide arm in a locked operating position of the drafting arrangement unit on the spinning machine.

12. The spinning machine as in claim 11, wherein the pressure arm comprises a second indentation at the upper portion thereof that engages an axle of the base carrier upon closing the load device, the pressure arm comprising a curve in a middle portion thereof that defines a space for accommodating a drive element configured with the bottom roller, the pressure arm comprising an additional curve in a lower portion thereof with a pressure thumb at the end of the lower portion that interacts with a pressure device in the drafting arrangement carrier.

13. The spinning machine as in claim 12, wherein the pressure arm is configured as a clamp that applies force at the indentation on its upper end that is transverse to a path of a sliver running through the spinning machine, with this force being counteracted at the lower portion of the pressure arm by a force transmitted from the pressure device to the pressure thumb, wherein these two forces form a closed triangle of forces with the reaction force between the pressure arm and base carrier.

14. The spinning machine as in claim 8, further comprising a plurality of the detachable drafting arrangement units that are interchangeable on the spinning machine via the fastening device.

15. The spinning machine as in claim 8, wherein the spinning machine is a roving machine for producing a roving from a fiber strand, the roving machine comprising a plurality of spinning stations, wherein each spinning station further comprises a twist generation device with the drafting arrangement unit arranged operably upstream from the twist generation device, the twist generation device further comprising a whirling chamber wherein at least a partial real twist is imparted to the fiber strand via an air flow within the whirling chamber.

16. The spinning machine as in claim 15, wherein the roving machine further comprises a winding apparatus.

17. The spinning machine as in claim 15, further comprising a drawing frame arranged upstream of the twist generation device.

* * * * *